US012385480B2

(12) United States Patent
Babbitt et al.

(10) Patent No.: US 12,385,480 B2
(45) Date of Patent: Aug. 12, 2025

(54) ACTIVE OIL INJECTION SYSTEM FOR A DIAPHRAGM COMPRESSOR

(71) Applicant: PDC MACHINES INC., Warminster, PA (US)

(72) Inventors: Guy Babbitt, Fort Collins, CO (US); Chris Turner, Windsor, CO (US); Bryce Whitehill, Fort Collins, CO (US); Michael Sprengel, Fort Collins, CO (US); Kareem Afzal, Gwynedd, PA (US)

(73) Assignee: PDC Machines Inc., Souderton, PA (US)

( * ) Notice: Subject to any disclaimer, the term of this patent is extended or adjusted under 35 U.S.C. 154(b) by 413 days.

(21) Appl. No.: 17/522,892

(22) Filed: Nov. 9, 2021

(65) Prior Publication Data

US 2022/0145874 A1 May 12, 2022

Related U.S. Application Data

(60) Provisional application No. 63/277,125, filed on Nov. 8, 2021, provisional application No. 63/111,356, filed on Nov. 9, 2020.

(51) Int. Cl.
*F04B 45/053* (2006.01)
*F04B 39/02* (2006.01)
(Continued)

(52) U.S. Cl.
CPC ..... *F04B 45/053* (2013.01); *F04B 39/02* (2013.01); *F04B 39/06* (2013.01); *F04B 39/16* (2013.01);
(Continued)

(58) Field of Classification Search
CPC ..... F04B 45/053; F04B 39/02; F04B 39/06; F04B 39/16; F04B 53/08; F04B 23/06;
(Continued)

(56) References Cited

U.S. PATENT DOCUMENTS 1,651,964 A * 12/1927 Nelson ..... F04B 45/0533 417/388
1,961,918 A * 6/1934 West ..... F04B 45/0333 417/388
(Continued)

FOREIGN PATENT DOCUMENTS

CN 203548120 U 4/2014
CN 205654517 U 10/2016
(Continued)

OTHER PUBLICATIONS

International Search Report and Written Opinion for PCT/US2021/058683 dated Feb. 4, 2022.
(Continued)

*Primary Examiner* — Mark A Laurenzi
*Assistant Examiner* — Benjamin Doyle
(74) *Attorney, Agent, or Firm* — Reed Smith LLP; Matthew P. Frederick; Cheryl L. Gastineau

(57) ABSTRACT

Devices and methods for operating a diaphragm compressor. Embodiments of the present disclosure comprise an oil piston being driven to pressurize work oil against the diaphragm of the compressor. In embodiments, an injection pump provides a supplemental flow of work oil in the region of pressurized fluid, and such pump may be part of an actively controlled system. In embodiments, a pressure relief valve vents an overpump flow of work oil, and such valve may be variable. Embodiments provide feedback and control mechanisms, including control of the injection pump and the relief valve.

24 Claims, 12 Drawing Sheets

(51) Int. Cl.

| | |
|---|---|
| ***F04B 39/06*** | (2006.01) |
| ***F04B 39/16*** | (2006.01) |
| ***F04B 43/073*** | (2006.01) |
| ***F04B 45/04*** | (2006.01) |
| ***F04B 49/22*** | (2006.01) |
| ***F04B 53/06*** | (2006.01) |
| ***F04B 53/08*** | (2006.01) |
| ***F04B 53/14*** | (2006.01) |

(52) U.S. Cl.
CPC ..... *F04B 43/073* (2013.01); *F04B 45/043* (2013.01); *F04B 45/0533* (2013.01); *F04B 45/0536* (2013.01); *F04B 49/22* (2013.01); *F04B 53/06* (2013.01); *F04B 53/14* (2013.01); *F04B 53/08* (2013.01); *F04B 2201/0201* (2013.01); *F04B 2201/0202* (2013.01); *F04B 2205/05* (2013.01)

(58) Field of Classification Search
CPC ..... F04B 45/043; F04B 45/0533; F04B 45/0536; F04B 49/03
USPC ..... 417/199.1
See application file for complete search history.

(56) References Cited

U.S. PATENT DOCUMENTS 2,532,462 A * 12/1950 Rockwell ..... B60T 11/10 91/372
2,578,746 A * 12/1951 Scherger ..... F04B 43/067 417/388
2,713,827 A * 7/1955 Hoop ..... F04B 45/0533 417/388
2,753,805 A * 7/1956 Boivinet ..... F04B 43/067 417/388
2,975,599 A * 3/1961 Bennett ..... F04B 43/067 417/387
3,000,320 A * 9/1961 Ring ..... F04B 43/067 417/567
3,234,882 A 2/1966 Douglas et al.
3,286,640 A * 11/1966 Bauer ..... F04B 43/067 417/385
3,416,453 A * 12/1968 Feuillebois ..... F04B 23/06 417/388
3,508,845 A * 4/1970 Strassburger ..... F04B 45/0533 417/388
3,625,254 A 12/1971 Rice
3,680,981 A * 8/1972 Wagner ..... F04B 43/067 417/388
3,790,125 A 2/1974 Swatty
3,804,162 A 4/1974 Kugler et al.
4,119,113 A * 10/1978 Meginniss, III .. B01F 35/88222 137/99
4,184,809 A * 1/1980 Kelley ..... F04B 43/067 417/387
4,213,298 A 7/1980 Milgram
4,353,684 A * 10/1982 Christman ..... F16K 15/063 417/388
4,373,865 A * 2/1983 Budzich ..... F04B 9/115 417/403
4,381,180 A 4/1983 Sell
4,450,685 A 5/1984 Corey
4,474,540 A * 10/1984 Bonastia ..... F04B 43/067 417/63
4,500,262 A * 2/1985 Sugino ..... F04B 53/142 417/214
4,540,346 A * 9/1985 Davies ..... F04B 43/067 417/273
4,565,501 A 1/1986 Laurendeau et al.
4,778,356 A * 10/1988 Hicks ..... F04B 9/1172 91/275
4,818,191 A * 4/1989 Schlake ..... F04B 9/113 91/275
4,828,464 A * 5/1989 Maier ..... F04B 43/067 417/63
4,854,832 A 8/1989 Gardner et al.
H928 H * 6/1991 Gallegos ..... F04B 45/053 417/395
5,020,974 A 6/1991 Searle
5,056,036 A * 10/1991 Van Bork ..... G05D 7/005 700/282
5,074,755 A * 12/1991 Vincent ..... F04B 43/067 417/18
5,106,274 A * 4/1992 Holtzapple ..... F04B 17/042 417/418
5,165,869 A * 11/1992 Reynolds ..... F04B 43/009 417/388
5,249,932 A * 10/1993 Van Bork ..... F04B 43/067 417/63
5,326,234 A 7/1994 Versaw et al.
5,531,013 A 7/1996 Nakamura
5,667,368 A * 9/1997 Augustyn ..... F04B 49/065 417/385
6,004,105 A 12/1999 Reynolds
6,071,089 A * 6/2000 Maier ..... F02M 59/14 417/388
6,079,959 A * 6/2000 Kingsford ..... F04B 53/164 417/393
6,206,664 B1 3/2001 Kakizawa
6,554,578 B1 * 4/2003 Siegel ..... F04B 43/0081 417/383
7,047,931 B2 * 5/2006 Sluka ..... F16H 61/0031 123/198 C
7,425,120 B2 * 9/2008 Hembree ..... F04B 43/067 417/387
9,022,746 B2 5/2015 Kroupa et al.
9,638,185 B2 * 5/2017 Hines ..... F04B 9/042
11,174,854 B2 11/2021 Hines et al.
11,486,374 B2 * 11/2022 Murakoshi ..... F04B 11/005
2002/0164255 A1 11/2002 Burr et al.
2003/0031565 A1 * 2/2003 Kleibrink ..... F04B 45/0533 417/388
2003/0123991 A1 7/2003 Chen et al.
2003/0152465 A1 * 8/2003 Duprey ..... F16K 7/061 417/307
2003/0170126 A1 9/2003 Klelbrink
2004/0241544 A1 12/2004 Nakaishi et al.
2005/0288834 A1 12/2005 Heiniger et al.
2006/0201148 A1 9/2006 Zabtcioglu
2006/0257271 A1 * 11/2006 Juterbock ..... F04B 43/0736 417/395
2008/0056916 A1 3/2008 Ferk et al.
2009/0196771 A1 8/2009 Juterbock et al.
2010/0045096 A1 * 2/2010 Schonlau ..... F04B 45/043 303/10
2010/0186433 A1 7/2010 Galante et al.
2012/0097121 A1 4/2012 Brennan et al.
2013/0101445 A1 * 4/2013 Schutze ..... F04B 43/073 417/395
2014/0323791 A1 10/2014 Das et al.
2015/0004003 A1 1/2015 Roberts et al.
2015/0240799 A1 8/2015 Obrejanu et al.
2015/0285238 A1 10/2015 Lynn et al.
2016/0131163 A1 * 5/2016 Tolbert ..... F16H 61/44 60/489
2016/0169218 A1 * 6/2016 Elliott ..... F04B 43/009 417/472
2016/0319810 A1 11/2016 Gibbs
2017/0009760 A1 * 1/2017 Lutz ..... F04B 43/0736
2018/0135616 A1 5/2018 Adams et al.
2018/0314274 A1 11/2018 Gibbs
2020/0191174 A1 6/2020 Tam et al.
2021/0148354 A1 * 5/2021 Adams ..... F04B 45/0533
2022/0080537 A1 3/2022 Inoue et al.

FOREIGN PATENT DOCUMENTS

EP 3643931 A1 4/2020
WO WO 2012167959 A1 12/2012
WO WO 2016077751 A1 5/2016

(56) References Cited

FOREIGN PATENT DOCUMENTS

| | | | |
|---|---|---|---|
| WO | WO 2017137498 | A1 | 8/2017 |
| WO | 2019011385 | A1 | 1/2019 |
| WO | WO 2022099220 | A1 | 5/2022 |

OTHER PUBLICATIONS

International Search Report and Written Opinion for PCT/US22/33565 dated Sep. 13, 2022.
International Search Report and Written Opinion for PCT/US22/33570 dated Sep. 21, 2022.
International Search Report and Written Opinion for PCT/US22/33574 dated Sep. 21, 2022.
International Search Report and Written Opinion for PCT/US21/58684 dated Feb. 2, 2022.
International Search Report and Written Opinion for PCT/US21/58683 dated Feb. 4, 2022.
International Search Report and Written Opinion for PCT/US22/49333 dated Feb. 17, 2023.

* cited by examiner

ACTIVE OIL INJECTION SYSTEM FOR A DIAPHRAGM COMPRESSOR

CROSS-REFERENCE TO RELATED APPLICATIONS

This application claims the benefit under 35 U.S.C. § 119(e) of the earlier filing date of U.S. Provisional Patent Applications No. 63/111,356 filed on Nov. 9, 2020 and No. 63/277,125 filed on Nov. 8, 2021, the disclosures of which are incorporated herein by reference in their entirety.

This application is related to co-pending and co-owned U.S. patent application Ser. No. 17/522,896 entitled "Hydraulic drive for diaphragm compressor", filed on Nov. 9, 2021, which is incorporated herein by reference in its entirety.

FIELD OF THE INVENTION

The present invention is directed to diaphragm compressors.

BACKGROUND OF THE INVENTION

A diaphragm compressor comprises a diaphragm that is actuated to pressurize a process gas for various purposes.

SUMMARY

A feature and benefit of embodiments is an active oil injection system in a diaphragm compressor comprising a diaphragm compressor, a hydraulic circuit, and a feedback mechanism. The diaphragm compressor comprises a compressor head. The compressor head comprises a work oil head support plate, a process gas head support plate, and a metallic diaphragm. The work oil head support plate and the process gas head support plate define a diaphragm cavity therebetween. The work oil head support plate comprises a piston cavity, an inlet, and an outlet. The diaphragm compressor further comprises a drive. The metallic diaphragm is mounted between the work oil head support plate and the process gas head support plate, dividing the diaphragm cavity into a work oil region and a process gas region. The work oil region is in separate communication with each of the piston cavity, the inlet, and the outlet. The metallic diaphragm is configured to actuate from a first position proximate the work oil head support plate to a second position proximate the process gas head support plate to pressurize process gas in the process gas region to a process gas discharge pressure. The drive is configured to intensify and supply primary work oil to the compressor head. The drive comprises a drive cavity, a piston, and an actuator. The drive cavity extends from the compressor head and is in communication with the work oil region via the piston cavity. The piston is mounted in the drive cavity and defines the volume of the work oil region. The actuator is configured to power the piston. During a discharge cycle, the drive is configured to power the piston to move toward the compressor head to intensify primary work oil in the work oil region from a first pressure to an intensified pressure and thereby actuate the diaphragm to the second position. The hydraulic circuit connects the outlet of the work oil head support plate to the inlet of the work oil head support plate. The hydraulic circuit comprises an oil reservoir, a hydraulic accumulator, and an injector pump. The oil reservoir is configured to collect overpumped work oil from the work oil region via the outlet of the work oil head support plate. The hydraulic accumulator is configured to provide a supply of supplemental work oil to the inlet of the work oil head support plate. The injector pump is in communication with the hydraulic accumulator and is configured to produce a variable volumetric displacement of the supplemental work oil from the oil reservoir to the hydraulic accumulator. The injector pump comprises a pump and a motor. The pump is operatively coupled to the hydraulic accumulator. The motor is configured to power the pump independently from the drive. The pressure relief mechanism is operatively coupled to the work oil region of the diaphragm cavity. The pressure relief mechanism comprises a pressure relief valve and a control valve. The pressure relief valve is in communication with the outlet of the work oil head support plate and configured to relieve the pressurized work oil from the work oil region. The pressure relief valve comprises a hydraulic relief setting corresponding to a target pressure condition of the pressurized work oil relative to the process gas discharge pressure. The control valve is configured to actively adjust the hydraulic relief setting of the pressure relief valve to correspond to a current condition of the process gas. The feedback mechanism is configured to control the injector pump. The feedback mechanism comprises a first measurement device. The first measurement device is operatively coupled to one or more of the outlet and the pressure relief valve. The measurement device is configured to detect a current condition of the pressurized work oil flowing through the pressure relief valve from the work oil region. The feedback mechanism is configured to adjust the volumetric displacement of the injector pump to the hydraulic accumulator in response to the detected current condition.

In certain embodiments, the hydraulic relief setting is a pressure of at least 1-20% above a measured process gas discharge pressure.

In certain embodiments, the oil reservoir is in fluid communication with the drive of the diaphragm compressor.

In certain embodiments, the actuator of the diaphragm compressor comprises a crank-slider mechanism. The oil reservoir comprises a crankcase of the crank-slider mechanism.

In certain embodiments, the hydraulic circuit further comprises an inlet check valve and an outlet check valve. The inlet check valve is operatively coupled to the inlet of the work oil head support plate. The inlet check valve is configured to prevent backflow from the work oil region to the hydraulic accumulator. The outlet check valve is operatively coupled to the outlet of the work oil head support plate. The outlet check valve is configured to prevent backflow from the hydraulic circuit to the work oil region.

In certain embodiments, during a suction cycle of the diaphragm compressor at the compressor head, the drive of the diaphragm compressor is configured to move the piston away from the compressor head to depressurize the work oil region and thereby pull the diaphragm to the first position. During the suction cycle, the hydraulic accumulator is configured to supply an injection volume of the supplemental work oil to the inlet of the work oil head support plate.

In certain embodiments, the injection volume from the hydraulic accumulator corresponds to the volume of overpump flow of pressurized work oil through the pressure relief valve.

In certain embodiments, during the discharge cycle of the diaphragm compressor, the injector pump is configured to charge the hydraulic accumulator.

In certain embodiments, the injector pump is configured to charge the hydraulic accumulator during both the discharge and suction cycles of the diaphragm compressor.

In certain embodiments, the pump and motor of the injector pump comprise a pump and motor selected from one of: of a variable speed motor with a fixed displacement hydraulic pump, a fixed speed motor with a variable displacement hydraulic pump, and a variable speed motor with a variable displacement hydraulic pump.

In certain embodiments, the hydraulic circuit further comprises a metering actuator operatively coupled to the inlet. The metering actuator is configured to inject the supplemental work oil selectively during each of a suction cycle and the discharge cycle of the diaphragm compressor.

In certain embodiments, the pressure relief valve comprises a valve spring and an adjustable pneumatic pressure bias, the control valve is configured to actively adjust the hydraulic relief setting by adjusting the pneumatic pressure bias.

In certain embodiments, the first measurement device of the feedback mechanism comprises one or more of: a flow meter downstream of the outlet, a position sensor in the pressure relief valve, and a pressure transducer with a temperature transducer each located downstream of the pressure relief valve.

In certain embodiments, the active oil injection system further comprises a hydraulic power unit driving the actuator of the diaphragm compressor.

In certain embodiments, the hydraulic power unit comprises a second hydraulic circuit of oil that is separate from the work oil of the hydraulic circuit of the active oil injection system.

In certain embodiments, the oil reservoir is a hydraulic tank operatively coupled with the hydraulic power unit. The injector pump comprises an active control valve configured to selectively isolate the injector pump from the hydraulic power unit of the diaphragm compressor.

In certain embodiments, the drive of the diaphragm compressor comprises a hydraulic drive supplied by a plurality of pressure rails configured to supply work oil to power the piston. The plurality of pressure rails comprises a low-pressure rail, a medium-pressure rail, and a high pressure-rail. The low-pressure rail supplies low-pressure work oil via a passive first valve. The medium-pressure rail supplies medium-pressure work oil via an active three-stage second valve. The high-pressure rail supplies high-pressure work oil via an active three-stage third valve.

In certain embodiments, the drive of the diaphragm compressor further comprises a hydraulic power unit providing the supply of work oil to the medium-pressure rail and the high-pressure rail. The hydraulic power unit comprising a hydraulic pump and motor.

A feature and benefit of embodiments is an active oil injection system in a diaphragm compressor comprising a diaphragm compressor, a hydraulic circuit, and a feedback mechanism. The diaphragm compressor comprises a first compressor head, a second compressor head, and a drive. The first compressor head comprises an inlet, an outlet, a first head cavity, and a first diaphragm. The first diaphragm divides the first head cavity into a first work oil region and a process gas region. The first diaphragm is configured to actuate to pressurize process gas in the process gas region. The second compressor head comprises an inlet, an outlet, a second cavity, and a second diaphragm. The second diaphragm divides the second head cavity into a second work oil region and a process gas region. The second diaphragm is configured to actuate to pressurize process gas in the process gas region. The drive is configured to intensify work oil and alternatingly provide intensified work oil to the first and second compressor heads. The hydraulic drive comprises a first diaphragm piston, a second diaphragm piston, and an actuator. The first diaphragm piston is configured to intensify work oil against the first diaphragm. The second diaphragm piston is configured to intensify work oil against the second diaphragm. The actuator is configured to power the first and second diaphragm pistons. The first diaphragm piston and the second diaphragm piston are configured to alternatingly intensify the work oil in the respective first or second diaphragm. The hydraulic circuit connects the outlet of the first compressor head to the inlet of the first compressor head and connects the outlet of the second compressor head to the inlet of the second compressor head. The hydraulic circuit comprises an oil reservoir, a hydraulic accumulator, and an injector pump. The oil reservoir is configured to collect overpumped work oil via the outlets of the first and second compressor heads. The hydraulic accumulator is configured to provide a supplemental supply of work oil to the inlets of the first and second compressor heads. The injector pump is in communication with the hydraulic accumulator. The injector pump is configured to produce a variable volumetric displacement of supplemental work oil from the oil reservoir to the hydraulic accumulator. The injector pump comprises a pump and a motor. The pump is operatively coupled to the hydraulic accumulator. The motor is configured to power the pump independently from the drive. The pressure relief mechanism comprises a first pressure relief valve, a first control valve, a second pressure relief valve, and a second control valve. The first pressure relief valve is in communication with the outlet of the first compressor head and is configured to relief an overpump of the pressurized work oil from the work oil region. The first pressure relief valve comprises a hydraulic relief setting corresponding to a first target pressure condition of the pressurized work oil relative to the process gas discharge pressure. The first control valve is configured to actively adjust the hydraulic relief setting of the first pressure relief valve to correspond to a current condition of the discharged process gas. The second pressure relief valve is in communication with the outlet of the second compressor head and is configured to relieve the pressurized work oil from the work oil region. The pressure relief valve comprises a hydraulic relief setting corresponding to a second target pressure condition of the pressurized work oil relative to the process gas discharge pressure. The second control valve is configured to actively adjust the hydraulic relief setting of the second pressure relief valve to correspond to the current condition. The feedback mechanism is configured to control the injector pump to maintain the first and second overpump target conditions. The feedback mechanism comprises one or more measurement devices configured to sense or measure the current condition. The feedback mechanism is configured to adjust the volumetric displacement of the injector pump in response to the current condition.

In certain embodiments, the hydraulic relief setting of the pressure relief valve is a fixed value corresponding to about 10-20% above a predetermined process gas discharge pressure.

In certain embodiments, the pressure relief valve is variable, the pressure relief mechanism further comprising a control valve configured to actively adjust the hydraulic relief setting of the pressure relief valve to correspond to the current condition. The hydraulic relief setting is a pressure of 10-20% above a process gas discharge pressure.

In certain embodiments, the drive is a hydraulic drive comprising a hydraulic actuator. The hydraulic drive comprises an actuator housing. The actuator housing comprising a drive cavity extending between the first and second compressor heads. The drive cavity comprises one or more inlets for work oil at one or more drive pressures. The first diaphragm piston defines a first variable volume region between the first diaphragm piston and the diaphragm of the first compressor head. The second diaphragm piston defines a second variable volume region between the second diaphragm piston and the diaphragm of the second compressor head.

A feature and benefit of embodiments is an active oil injection system in a hydraulically powered diaphragm compressor comprising a hydraulically powered diaphragm compressor, a hydraulic circuit, and a feedback mechanism. The hydraulically powered diaphragm compressor comprises a first compressor head, a second compressor head, and a hydraulic drive. The first compressor head comprises an inlet, an outlet, a first head cavity, and a first diaphragm. The first diaphragm divides the first head cavity into a first work oil region and a process gas region. The first diaphragm is configured to actuate to pressurize process gas in the process gas region. The second compressor head comprises an inlet, an outlet, a second head cavity, and a second diaphragm. The second diaphragm divides the second head cavity into a second work oil region and a process gas region. The second diaphragm is configured to actuate to pressurize process gas in the process gas region. The hydraulic drive is configured to intensify work oil and alternatingly provide intensified work oil to the first and second compressor heads. The hydraulic drive comprises a first diaphragm piston, a second diaphragm piston, and a hydraulic actuator. The first diaphragm piston configured to intensify work oil against the first diaphragm. The second diaphragm piston is configured to intensify work oil against the second diaphragm. The hydraulic actuator is configured to power the first and second diaphragm pistons. The first diaphragm piston and the second diaphragm piston are configured to alternatingly intensify the work oil in the respective first or second work oil region to an intensified pressure and thereby actuate the respective first or second diaphragm. The hydraulic circuit connects the outlet of the first compressor head and connects the outlet of the second compressor head to the inlet of the second compressor head. The hydraulic circuit comprises an oil reservoir, a hydraulic accumulator, and an injector pump. The oil reservoir is configured to collect overpumped work oil via the outlets of the first and second compressor heads. The hydraulic accumulator is configured to provide a supplemental supply of work oil to the inlets of the first and second compressor heads. The injector pump is in communication with the hydraulic accumulator. The injector pump is configured to produce a variable volumetric displacement of supplemental work oil from the oil reservoir to the hydraulic accumulator. The injector pump comprises a pump and a motor. The pump is operatively coupled to the hydraulic accumulator. The motor is configured to power the pump independently from the drive. The pressure relief mechanism comprises a first pressure relief valve and a second pressure relief valve. The first pressure relief valve is in communication with the outlet of the first compressor head and is configured to relief the pressurized work oil from the work oil region. The first pressure relief valve comprises a hydraulic relief setting corresponding to a first target pressure condition of the pressurized work oil relative to the process gas discharge pressure. The second pressure relief valve is in communication with the outlet of the second compressor head and is configured to relieve the pressurized work oil from the work oil region, the pressure relief valve comprises a hydraulic relief setting corresponding to a second target pressure condition of the pressurized work oil relative to the process gas discharge pressure. The feedback mechanism is configured to control the injector pump. The feedback mechanism comprises one or more measurement devices configured to sense or measure a current condition of the intensified work oil flowing out one or more of the first compressor head and the second compressor head. The feedback mechanism is configured to adjust the volumetric displacement of the injector pump in response to the current condition. The above summary of the various representative embodiments of the invention is not intended to describe each illustrated embodiment or every implementation of the invention. Rather, the embodiments are chosen and described so that others skilled in the art can appreciate and understand the principles and practices of the invention. The Figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
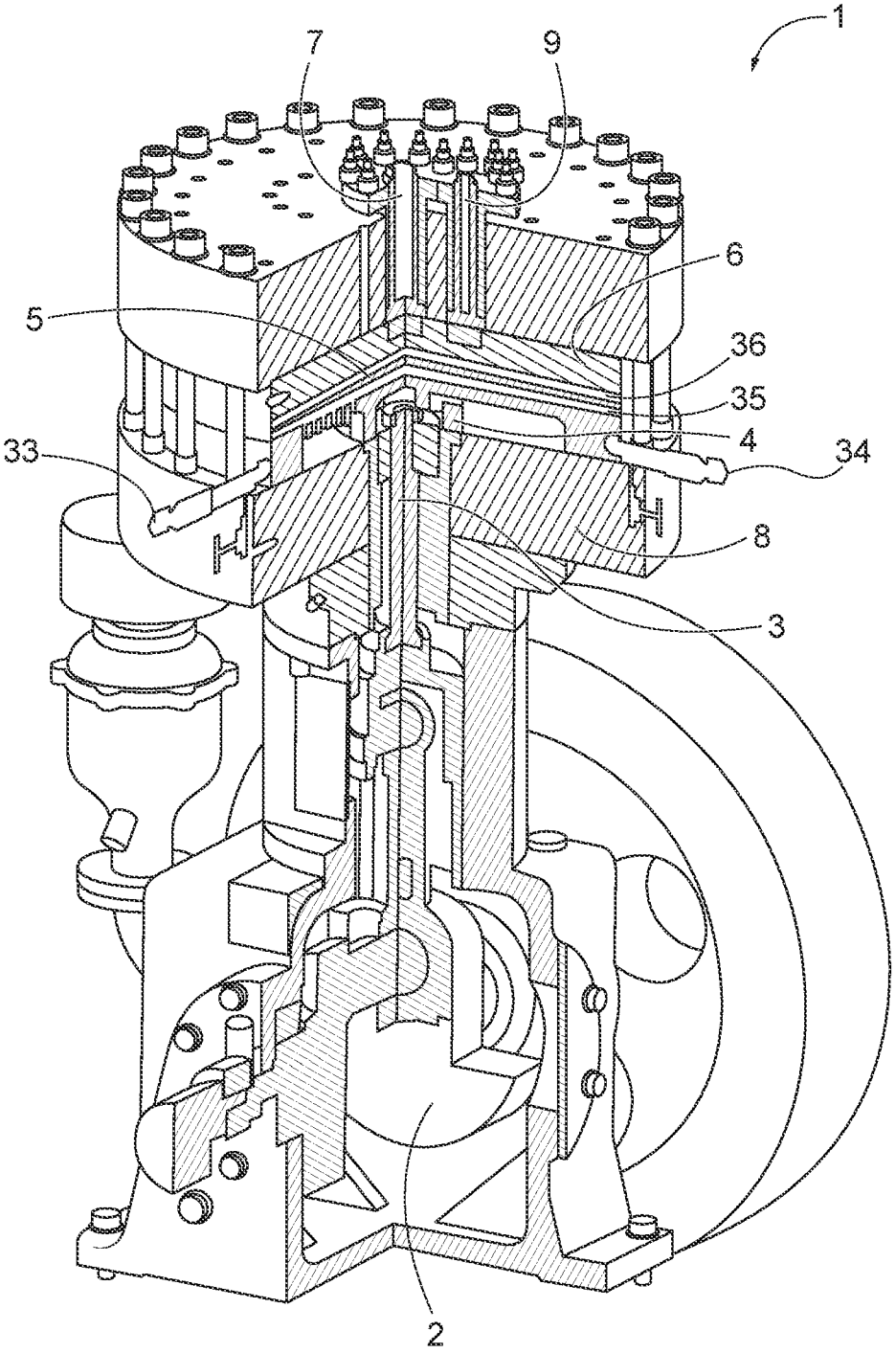
FIG. 1 is front perspective and sectional view of a crank-driven diaphragm compressor in accord with embodiments of the present disclosure.
Figure 2:
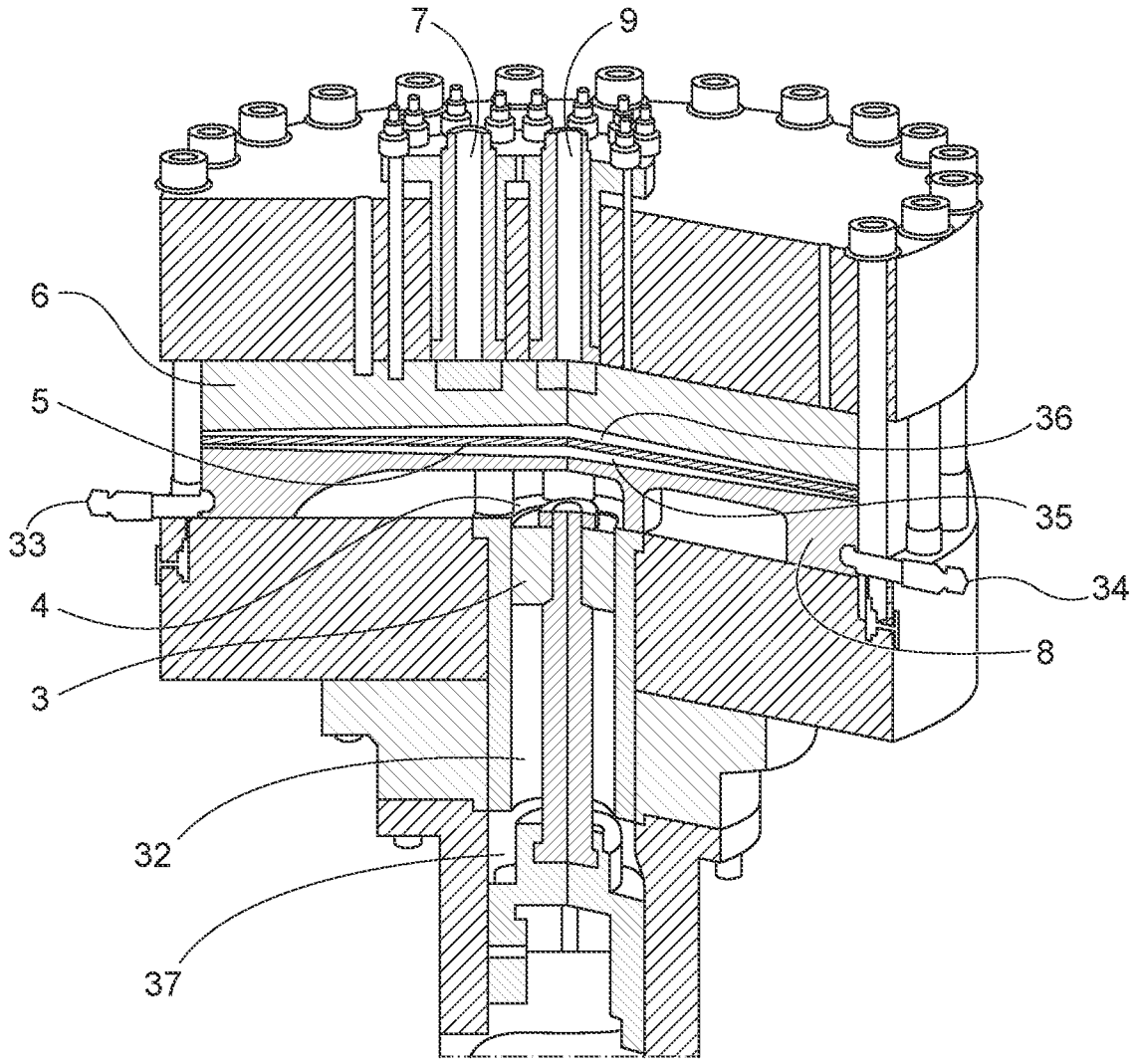
FIG. 2 is a side cross-sectional view of a compressor head of the compressor of FIG. 1.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

In some embodiments such as the one shown in FIG. 1, a diaphragm compressor 1 employs a crank 2 to drive a high pressure oil piston 3 that moves a column of hydraulic fluid 4 through the compressor 1 suction and discharge cycles. Process gas compression occurs as the volume of hydraulic fluid 4 is pushed upward to fill the lower plate 8 cavity, exerting a uniform force against the bottom of the diaphragm 5. This deflects the diaphragm 5 into the upper cavity in the gas plate 6 that is filled with the process gas. The deflection of the diaphragm 5 against the upper gas plate 6 cavity first compresses the gas and then expels it through the discharge check valve 7. As the oil piston 3 reverses to begin the suction cycle, the diaphragm 5 is drawn downward to hug the lower cavity of the oil plate 8 while the inlet check valve 9 opens and fills the upper cavity with a fresh charge of gas. The oil piston 3 passes through bottom dead center and begins its upward stroke, and the compression cycle is repeated.

In certain embodiments, the diaphragm 5 may be metallic, a composite material, or may be formed of any material with suitable flexibility and strength to meet compressor demands. In embodiments, the diaphragm 5 is a diaphragm set comprises a plurality of diaphragm plates sandwiched together and acting in unison, for example two, three, four, or more diaphragm plates may comprise a diaphragm set. The diaphragm plates of such a set may be formed from the same or different materials.

Figure 3:
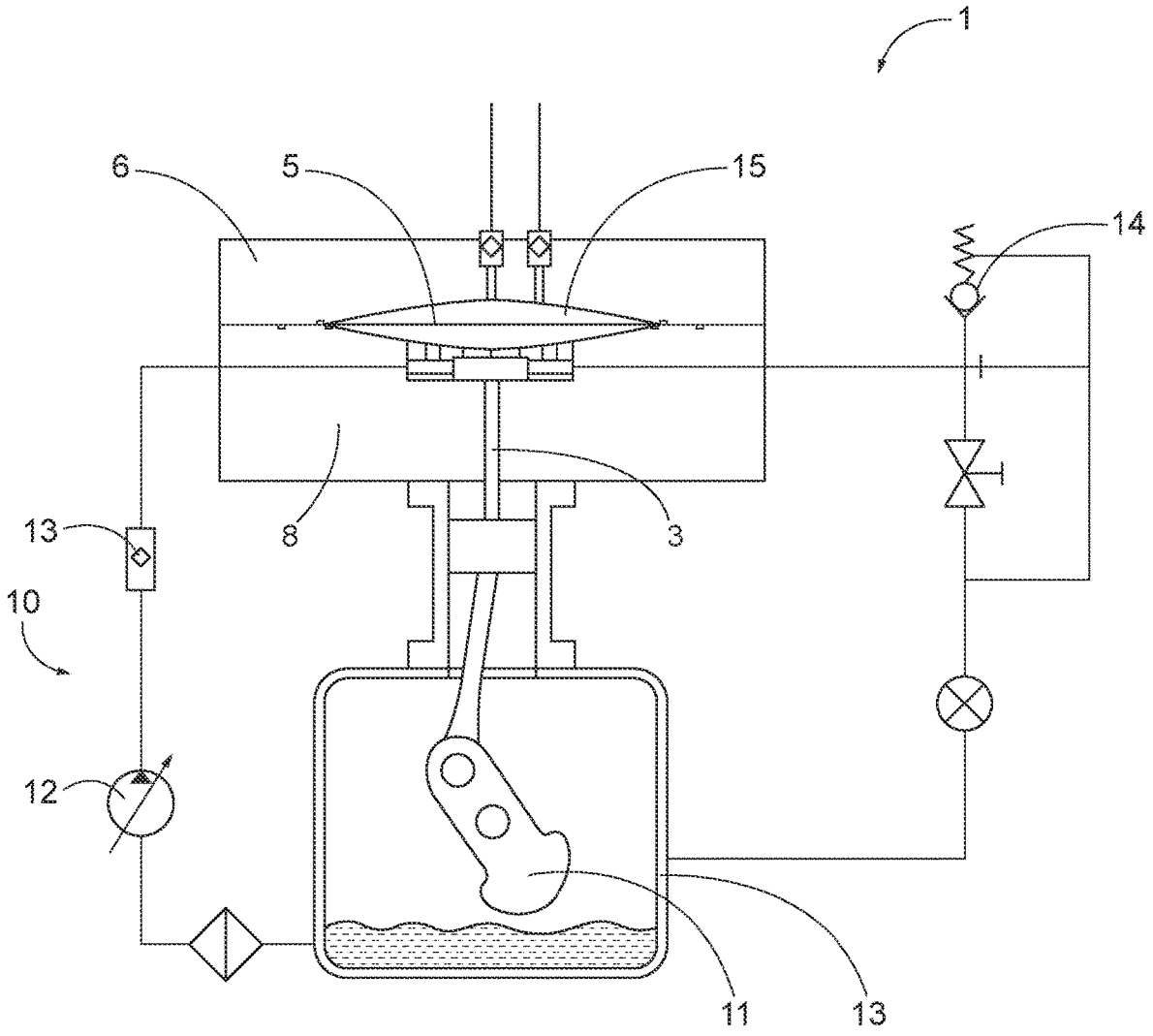
FIG. 3 is a schematic view of the compressor of FIG. 1 with an injection pump system in accord with embodiments of the present disclosure.

In some embodiments, the diaphragm compressor 1 employs a cam driven hydraulic injection pump system 10 that is driven off the primary crankshaft 11 of the compressor 1. The hydraulic injection pump system 10 consists of a crank driven radial piston pump 12, at least one oil check valves 13 and a fixed setting oil relief valve 14 as illustrated in FIG. 3. The injection pump system's 10 primary function is to maintain the required oil volume between the high-pressure oil piston 3 and diaphragm 5. During the compressor's 1 suction stroke, a fixed volume of hydraulic fluid is injected into the compressor 1 by the radial piston pump's 12 plunger driven by a cam connected to the compressor's 1 crankshaft 11. This mechanical linkage ensures a fixed volume of oil is injected during each suction stroke to ensure the oil volume is maintained for proper compressor 1 performance.

In certain embodiments the oil volume between the high-pressure oil piston 3 and diaphragm 5 is impacted by two modes of oil loss. The first mode of oil loss is annular leakage past the high-pressure oil piston 3 back to the ambient pressure crankcase 13. This annular leakage is most significant on high pressure compressors 1 operating above 5,000 psi due to the use of match fit high pressure oil pistons 3 and bores. At pressures above 5,000 psi, dynamic sealing technologies with the required life expectancy are limited, so the use of a match fit piston and bore provides a robust solution without seals. However, this architecture is prone to more significant annular leakage during compressor 1 operation due to the small clearances between the piston and the bore. Leakage past the high-pressure oil piston 3 is a function of oil temperature, oil pressure, fluid viscosity and manufacturing tolerances, among other factors. During the compressor's 1 operation, parameters such as hydraulic oil temperature and pressure vary significantly so the actual annular leakage past the high-pressure oil piston 3 varies significantly during operation.

The second mode of oil loss is defined as "overpump," which is hydraulic flow over the oil relief valve 14 back to the crankcase 13 which occurs every cycle during normal compressor 1 operation. The injector pump system 10 is designed and operated to maintain an "overpump" condition of work oil flow through the oil relief valve 14 in each discharge cycle ensuring the diaphragms 5 are sweeping the entire compressor cavity 15 thereby maximizing volumetric efficiency of the compressor 1.

Crank-based injection pump systems 10 are mechanically adjustable by a user to vary the radial piston pump's 12 volumetric flow rate into the compressor 1. However, this requires manual observations and adjustment. An incorrect volumetric displacement setting of the radial piston pump 12 can lead to various machine failures and loss of process.

Figure 5A:
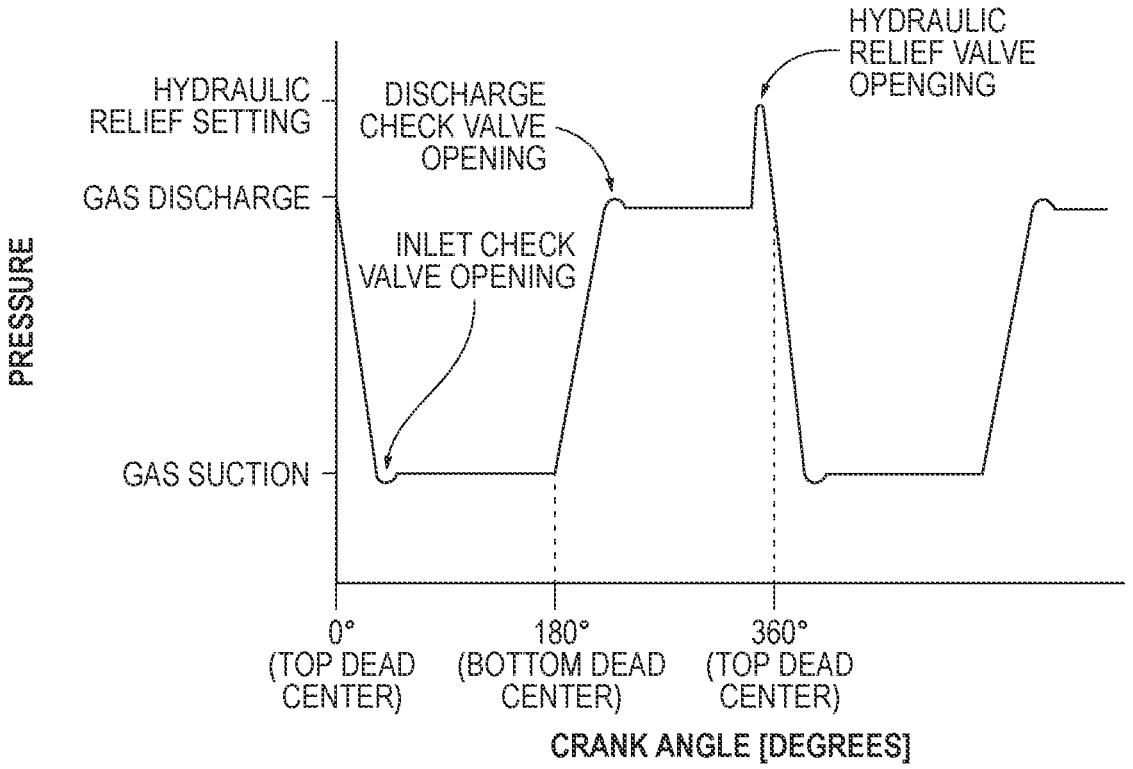
FIG. 5A is a pressure graph for a crank-driven diaphragm compressor.

In certain embodiments, the oil relief valve 14 has a manually adjustable relief setting. The oil relief valve 14 is set to a fixed oil relief pressure setting that is at least 10-20% higher than the maximum process gas pressure. The maximum process gas pressure is the maximum expected pressure of the process gas for any particular use case. This elevated relief setting allows the diaphragm 5 to contact the top of the gas plate 6 cavity 15 firmly before any hydraulic fluid flows over the relief valve 14, thus, assuring a complete sweep of the entire cavity 15 volume at the highest expected pressure of the process gas. When the diaphragm 5 contacts the top of the cavity 15, the oil piston 3 still has a few degrees of crank 2 angle left before it reaches top dead center ("TDC"). During this period, the oil compresses further and the hydraulic pressure rises above the compressor 1 gas discharge pressure until it reaches the setting of the oil relief valve 14. At this point, the oil relief valve 14 opens and oil, in the amount of the injection pump displacement per revolution less the annular leakage in the hydraulic injection pump system 10, is displaced over the oil relief valve 14. This oil flow out of the relief valve 14 is defined as overpump. FIG. 5A illustrates a compression cycle for a diaphragm compressor 1 operating at maximum process gas pressure.

Figure 5B:
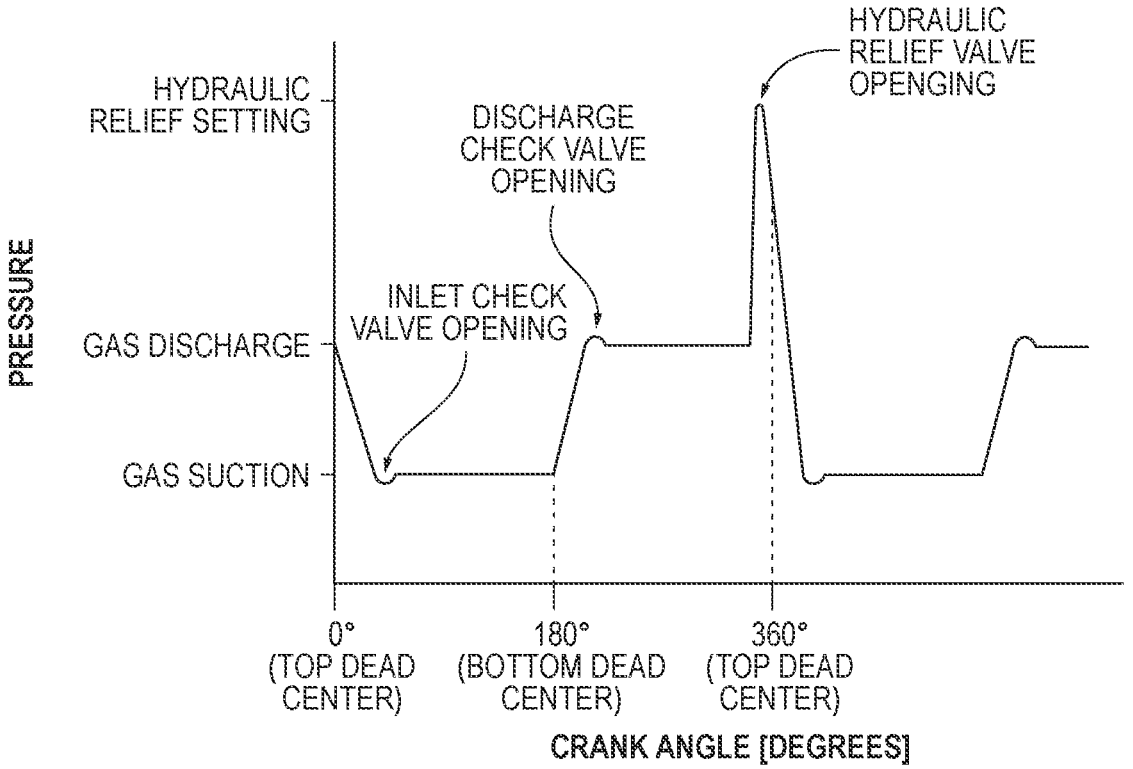
FIG. 5B is a pressure graph for a crank-driven diaphragm compressor.

A manually adjustable oil relief valve 14 is typically set to a fixed hydraulic relief setting. This design assumes and requires that the hydraulic pressure within the cavity 15 reaches this relief set point each cycle during normal compressor operation. FIG. 5B shows a compression cycle for a compressor 1 with an oil relief valve 14 set for maximum process gas pressure, but where the actual process gas pressure is much lower, for example, at the beginning of filling a large storage tank with process gas. This additional difference between process gas pressure and fixed hydraulic relief setting generates a large alternating stress within the compressor which can decrease fatigue resistance as a result of higher amplitude equivalent stresses experienced by the compressor each cycle.

Certain embodiments of the present invention include an active oil injection system 30 ("AOIS") in a diaphragm compressor 1. In those embodiments, the diaphragm compressor 1 includes a compressor head 31 including a work oil head support plate 8 and a process gas head support plate 6 defining a diaphragm cavity 15 therebetween. In those embodiments, the work oil head support plate 8 comprises a piston bore 32, which operates as a cylinder for the oil piston 3. In certain embodiments, the work oil head support plate 8 also includes an inlet 33, and an outlet 34, which allow work oil to enter the work oil head support plate 8 through the inlet 33, and exit through the outlet 34. The compressor head 31 may also include a metallic diaphragm 5 mounted between the work oil head support plate 8 and the process gas plate 6. In those embodiments, the diaphragm 5 divides the diaphragm cavity 15 into a work oil region 35 and a process gas region 36. In some embodiments, the work oil region 35 is in separate communication with each of the piston bore 32, the inlet 33, and the outlet 34. In other words, the work oil region 35 is in fluid communication with each of the piston bore 32, where work oil can enter and leave the work oil region 35, the inlet 33, where work oil can enter the work oil region 35, and the outlet 34, where work oil can exit work oil region 35.

In some embodiments, the diaphragm 5 is configured to actuate from a first position proximate the work oil head support plate 8 to a second position proximate the process gas plate 6 to pressurize process gas in the process gas region 36 to a process gas discharge pressure.

Certain embodiments include an actuator configured to power the oil piston 3, wherein, during a discharge cycle, the drive is configured to power the oil piston 3 to move toward the compressor head 31 to intensify primary work oil in the work oil region 35 from a first pressure to an intensified pressure and thereby actuate the diaphragm 5 to the second position.

In certain embodiments, the intensified pressure is at least 5,000 psi. In other embodiments, the intensified pressure is at least 7,500 psi, at least 10,000 psi, or at least 15,000 psi. In still other embodiments, the intensified pressure is from about 5,000 psi to about 15,000 psi.

In certain embodiments, a drive is a mechanical drive such as a crank-slider system comprising the crankshaft 11 and is configured to intensify and supply primary work oil to the compressor head 31, the drive including a drive cavity 37 extending from the compressor head 31 and in communication with the work oil region 35 via the piston bore 32, and an oil piston 3 mounted in the drive cavity 37. The oil piston 3 defines the volume of the work oil region 35 between a top face of the oil piston 3, and a bottom face of the diaphragm 5, and because the oil piston 3 and diaphragm 5 are dynamic, the volume of the work oil region 35 is variable. In certain embodiments, the drive can be a mechanical drive such as a crankshaft 11, and in other embodiments, the drive can be a hydraulic actuator 110. In some embodiments, the drive of the diaphragm compressor 1 is a crank-slider mechanism such as the crank drive 2 described above, and the oil reservoir 38 is a crankcase of the crank-slider mechanism. In other embodiments, the drive includes a hydraulic power unit 118 driving the actuator of the diaphragm compressor 1. In some embodiments, the hydraulic power unit 118 includes a second hydraulic circuit 160 of oil that is separate from the work oil of the hydraulic circuit of the AOIS system 30. In further embodiments, the oil reservoir 38 includes a hydraulic tank operatively coupled with the hydraulic power unit 118, and the injector pump 40 includes a control valve 46. In embodiments, the control valve 46 may be configured to selectively isolate the injector pump 40 from the hydraulic power unit 118 of the diaphragm compressor 1. In other embodiments, the control valve 46 comprises one or more valves that can selectively connect the injector pump 40 to one or more compressor heads (e.g., first and second compressor heads 31, 51). In further embodiments, the control valve 46 comprises one or more valves configured to selectively connect the injector pump 40 to one or more compressors (e.g., compressor 1 and another diaphragm compressor not shown). In this manner, the AOIS system 30 and the hydraulic circuit 60 are configured to supply supplementary work oil to one or more compressors and/or supply supplementary work oil to one or more compressor heads.

In some embodiments, the drive of the diaphragm compressor 1 comprises a hydraulic drive 110 supplied by a plurality of pressure rails (not shown) configured to supply work oil to power the oil piston 3. In some embodiments, the plurality of pressure rails includes a low-pressure rail supplying low-pressure work oil (e.g., work oil slightly above ambient pressure or at a pressure of about 500 psi, or less than 500 psi) via a passive first valve, a medium-pressure rail supplying medium-pressure work oil via an active second valve, and a high-pressure rail supplying high-pressure work oil via an active third valve. In some embodiments, the drive of the diaphragm compressor 1 further includes a hydraulic power unit 118 providing the supply of work oil to the medium-pressure rail and the high-pressure rail, the hydraulic power unit 118 comprises a hydraulic pump and motor dedicated to the hydraulic drive 110.

In certain embodiments, the compressor 1 forms a hydraulic circuit 60 connecting the outlet 34 of the work oil head support plate 8 to the inlet 33 of the work oil head support plate 8. In those embodiments, the hydraulic circuit may also include an oil reservoir 38 configured to collect overpumped work oil from the work oil region 35 via the outlet 34 of the work oil head support plate 8. By forming a hydraulic circuit, oil is circulated from the oil reservoir 38, through the inlet 33 and into the work oil region 35, and then overpumped out the outlet 34 and back into the oil reservoir 38. In other embodiments, the oil reservoir 38 is in fluid communication with the drive of the diaphragm compressor 1.

Figure 6:
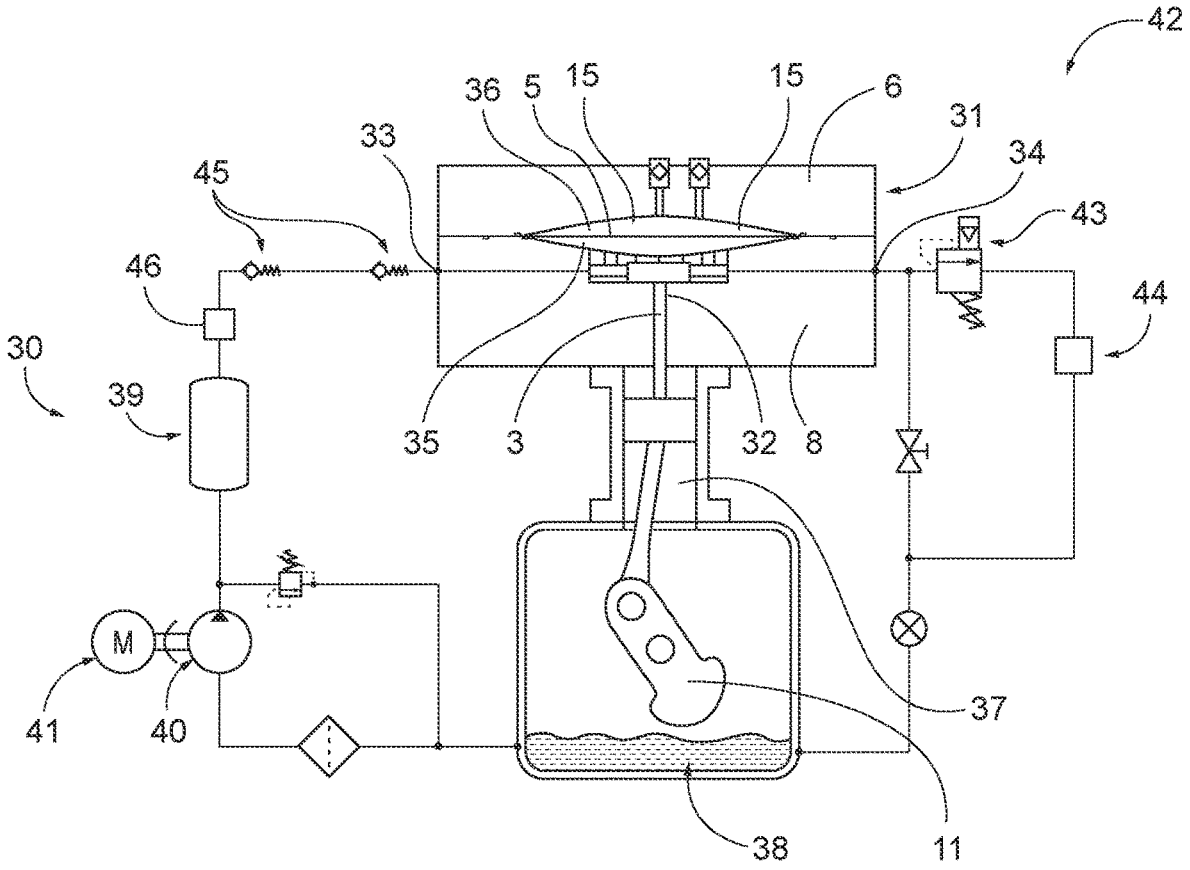
FIG. 6 is a schematic view of a crank-driven compressor with an embodiment of an active oil injection system (AOIS) in accord with embodiments of the present disclosure.

In other embodiments shown in FIG. 6, the hydraulic circuit 60 also comprises the AOIS 30 including a hydraulic accumulator 39 configured to provide a supply of supplemental work oil to the inlet 33 of the work oil head support plate 8. In certain embodiments, the hydraulic accumulator 39 may be a hydraulic volume or any style of hydraulic accumulator 39 such as a bladder, piston, or diaphragm gas over fluid style hydraulic accumulator. In still further embodiments, the AOIS includes an injector pump 40, the injector pump 40 configured to produce a variable volumetric displacement of the supplemental work oil from the oil reservoir 38 or 138 to the hydraulic accumulator 39 or directly to the inlet 33 without an accumulator. As used herein, variable volumetric displacement means that the AOIS system 30 can provide a variable volumetric flow, i.e. variable injection quantities of work oil, to the work oil region 35 depending on the particular process conditions of the compressor head 31. This allows for variable injection quantities during the compressor's 1 operation to maintain the compressor's 1 oil volume most efficiently within the compressor 1, and particularly the work oil region 35. In certain embodiments, this allows the AOIS system to actively adjust the amount of supplemental work oil being supplied to the hydraulic accumulator 39 or directly to the inlet 33 during operation of compressor head 31 in direct response to conditions work oil region 35. In certain embodiments, the AOIS system 30 comprises an injector pump 40 operatively coupled to the hydraulic accumulator 39, and a motor 41 configured to power the injector pump 40 independently from the drive. In other words, the speed and control of the motor 41 is completely independent from, and not mechanically linked to or dependent upon, the mechanical or hydraulic drive that powers the oil piston 3.

In certain embodiments, the hydraulic circuit 60 further includes at least one inlet check valve 45 operatively coupled to the inlet 33 of the work oil head support plate 8, the inlet check valve 45 configured to prevent backflow from the work oil region 35 to the hydraulic accumulator 39. In further embodiments, the hydraulic circuit further includes an outlet check valve operatively coupled to the outlet 34 of the work oil head support plate 8, the outlet check valve configured to prevent backflow from the hydraulic circuit to the work oil region 35.

In some embodiments, the hydraulic circuit 60 further includes a metering actuator 52 (FIG. 8) operatively coupled to the inlet 33, the metering actuator configured to inject the supplemental work oil selectively during each of a suction cycle and the discharge cycle of the diaphragm compressor 1.

In certain embodiments, during a suction cycle of the diaphragm compressor 1 at the compressor head 31, the drive of the diaphragm compressor 1 is configured to move the oil piston 3 away from the compressor head 31 to depressurize the work oil region 35 and thereby pull the diaphragm 5 to the first position. In other embodiments, during the suction cycle, the hydraulic accumulator 39 is configured to supply an injection volume of the supplemental work oil to the work oil region 35 via the inlet 33 of the work oil head support plate 8. In other embodiments, the injection volume from the hydraulic accumulator 39 corresponds to the outlet volume of pressurized work oil through the pressure relief valve 43, and a volume of annular leakage. In further embodiments, during the discharge cycle of the diaphragm compressor 1, the injector pump 40 is configured to charge the hydraulic accumulator 39. In still further embodiments, the injector pump 40 is configured to charge the hydraulic accumulator 39 during both the discharge and suction cycles of the diaphragm compressor 1.

Figure 7:
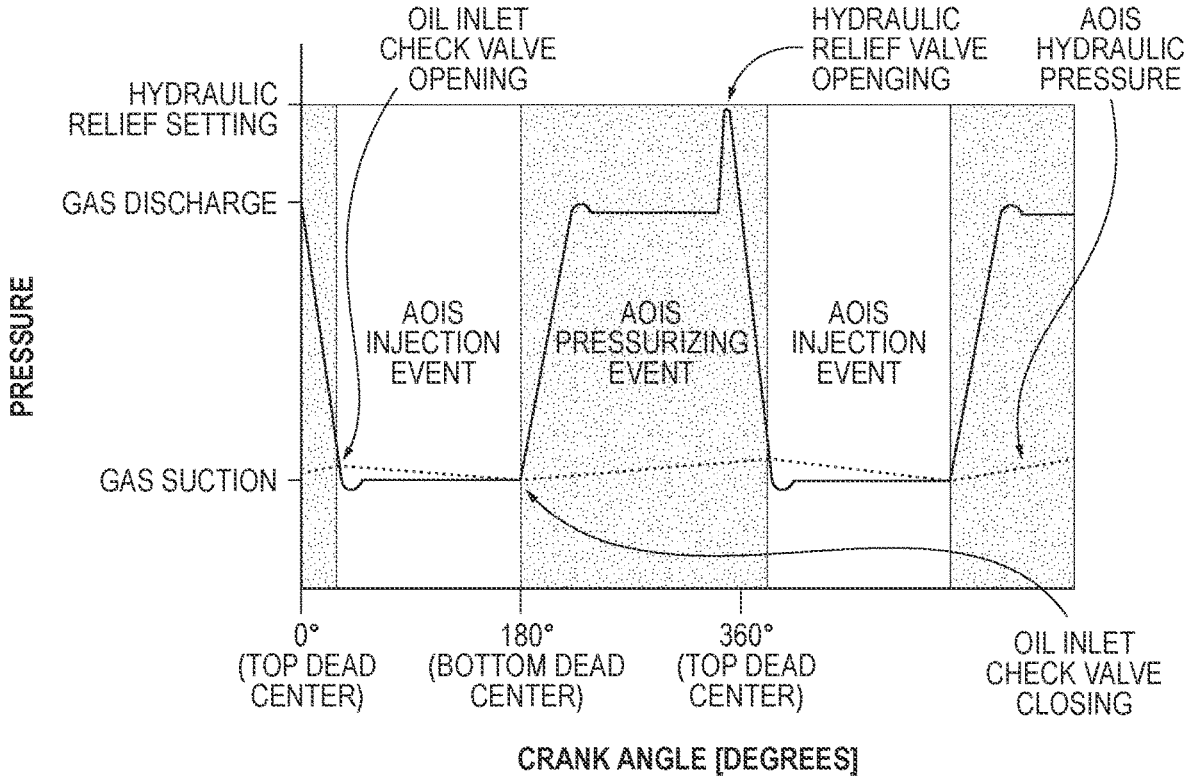
FIG. 7 is a pressure graph for the compressor of FIG. 6.

In certain embodiments, the AOIS utilizes the existing pressure dynamics within the compressor 1 to satisfy the hydraulic flow requirements into the compressor 1, and particularly into the work oil region 35. As the compressor 1 transitions through its suction and discharge cycles, the AOIS pump 40 charges and discharges the hydraulic accumulator 39. During the compressor's 1 suction stroke, this lower pressure condition within the compressor 1, including the work oil region 35, creates a positive pressure differential between the hydraulic accumulator 39 and the oil within the compressor head 31, and particularly in the work oil region 35. During this suction condition, hydraulic flow goes through the oil inlet check valves 45 and through inlet 33 into the work oil region 35 satisfying the injection event. During this time, the injector pump 40 may be continuously pumping into the hydraulic accumulator 39. During this discharge stroke, the hydraulic pressure within work oil region 35 is greater than the pressure in the hydraulic accumulator 39 therefore there is no flow from the hydraulic accumulator 39 into the compressor 1. At least one inlet check valve 45, and in some embodiments at least two inlet check valves 45, prevent backflow from the work oil region 35 into the hydraulic accumulator 39 and beyond. During this this condition, the hydraulic flow from the AOIS pump 40 pressurizes the hydraulic accumulator 39 in preparation for the next injection event. This series of injection and pressurizing events as they relate to the compressor's 1 suction and discharge cycles is illustrated in FIG. 7.

In certain embodiments, the injector pump 40 is configured to produce a variable volumetric displacement of the supplemental work oil from the oil reservoir 38 to the hydraulic accumulator 39. In some embodiments, the motor 41 includes a variable speed motor 41 and the injector pump 40 includes a fixed displacement hydraulic injector pump 40. The motor 41 speed is actively controlled and adjusted to control volumetric displacement of the fixed displacement pump 40 into the hydraulic accumulator 39. The active control of the volumetric displacement results in a certain change in pressure within the hydraulic accumulator 39 to satisfy the AOIS injection events. In certain embodiments, the variable speed motor 41 could be servo, AC induction, among others and driven by a common controller or variable frequency drive (VFD), among others.

In other embodiments, the motor 41 includes a fixed speed motor and the injector pump 40 includes a variable displacement hydraulic injector pump 40. The motor 41 speed would remain constant during operation and the variable displacement pump 40 would be controlled to produce enough flow to attain the desired pressure in hydraulic accumulator 39 to satisfy the AOIS injection events.

In still further embodiments, the motor 41 includes a variable speed motor 41 and the injector pump 40 includes a variable displacement hydraulic injector pump 40. The combination of variable speed motor 41 and variable speed injector pump 40 allows for variable hydraulic delivery and maintain maximum system efficiency as the variable displacement pump 40 can be operated in its maximum efficiency ranges. The active control of the volumetric displacement would result in a certain change in pressure within the hydraulic accumulator 39 to satisfy the AOIS injection events.

In other embodiments, the AOIS system 30 includes a control valve 46 added to any of the mentioned injector pump 40 embodiments. The addition of a control valve 46 allows the injector pump 40 to be isolated from the compressor 1 for failure mode prevention and independent cycle to cycle injection control, among others. In certain embodiments, the control valve 46 could be a solenoid valve or a proportional valve, among others.

Figure 8:
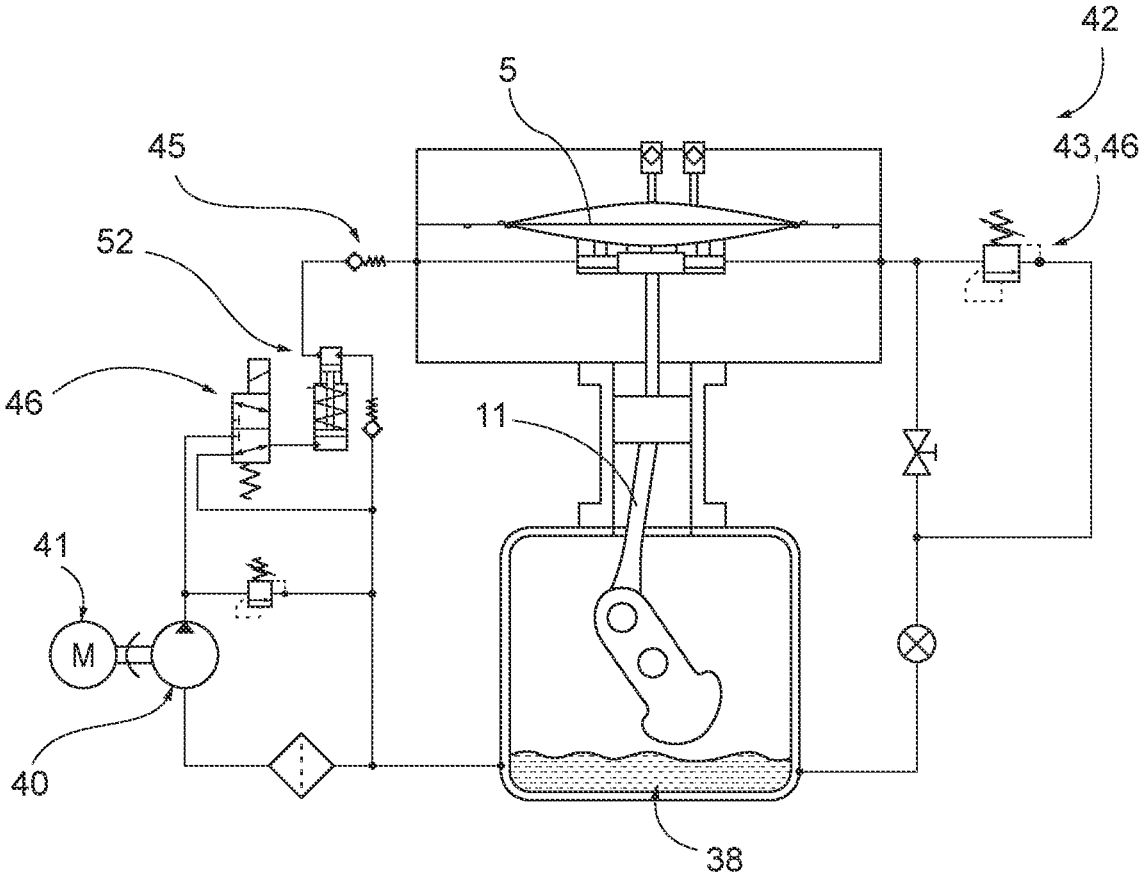
FIG. 8 is a schematic view of a crank-driven compressor with an embodiment of an active oil injection system (AOIS) in accord with embodiments of the present disclosure.

In still other embodiments, the AOIS system 30 includes a metering actuator that can be actuated to displace a fixed or variable hydraulic volume into the compressor 1, as shown in FIG. 8. The independent control of the actuator allows for injection events to occur during the compressor's 1 suction and discharge cycles, if desired.

Further embodiments include a variable pressure relieve valve (VPRV), which includes a pressure relief mechanism 42 operatively coupled to the work oil region 35 of the diaphragm cavity 15, the pressure relief mechanism 42 including a pressure relief valve 43 in communication with the outlet 34 of the work oil head support plate 8 and configured to relieve an outlet volume of the pressurized work oil from the work oil region 35. In these embodiments, the pressure relief valve 43 includes a hydraulic relief setting corresponding to an target pressure condition of the pressurized work oil relative to the process gas discharge pressure. In some embodiments, the target pressure condition corresponds to a maximum process gas discharge pressure. In other words, the target pressure condition corresponds to a maximum process gas discharge pressure that the compressor head 31 is configured to operate at for a particular mode of operation, so that the process gas region 36 is configured to be completely evacuated by the diaphragm 5 at maximum gas discharge pressure.

In certain embodiments, during an oil relief event during the discharge cycle, the relief valve 43 opens and oil, in the amount of the injection volume per revolution less the annular leakage in the system, is displaced over the oil relief valve 434, defined as overpump. During this time, the hydraulic flow from the injector pump 40 pressurizes the hydraulic accumulator 39 in preparation for the next injection event during the next suction cycle.

However, in certain embodiments, the pressure relief valve 43 is configured to actively adjust the hydraulic relief setting of the pressure relief valve 43 to correspond to a current condition of the process gas. In other words, the pressure relief valve 43 is configured to adjust the hydraulic relief setting up or down corresponding to a relative increase or decrease in process gas discharge pressure. The current condition corresponds to the measured process gas discharge pressure being experienced at the compressor head 31 in real time or as otherwise measured by the system. In certain embodiments, the hydraulic relief setting corresponds to pressure 10-20% above a measured process gas discharge pressure. In other embodiments, the hydraulic relief setting corresponds to pressure 1-10% above a measured process gas discharge pressure. In still further embodiments, the hydraulic relief setting corresponds to pressure one of 1-20%, and 1-5% above a measured process gas discharge pressure. The "current" and "real time" discussed throughout the present disclosure can include measurements that are recent or immediately preceding a given time, and moreover can include a calculation or estimation of the current condition based on related data or previous measurements.

Figure 9:
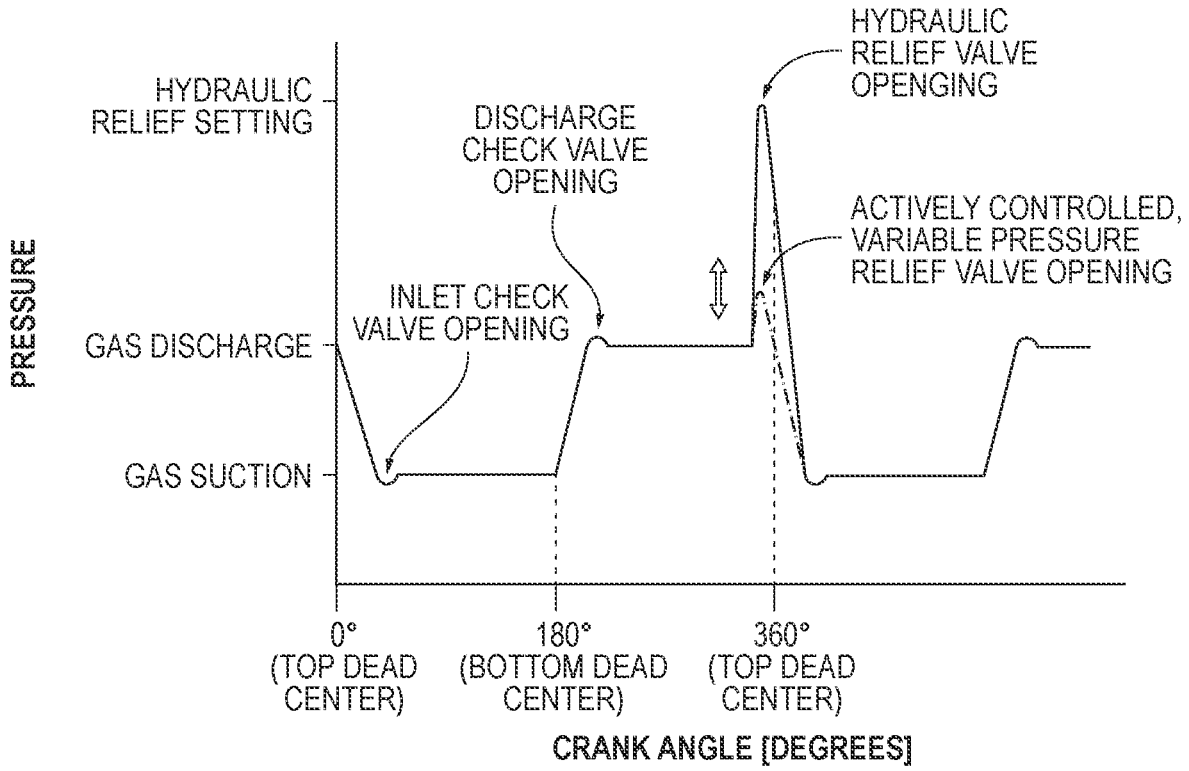
FIG. 9 is a pressure graph for the compressor of FIG. 8.

The use of a fixed setting pressure relief valve 43 that corresponds to the maximum process gas discharge pressure leads to higher cyclic stresses within the compressor 1 than otherwise necessary, potentially reducing overall compressor life expectancy. The large alternating stress is driven by the gap between lower process gas discharge pressures (e.g., pressure of discharges that occur at the beginning of filling a tank) compared to the maximum process gas discharge pressure, while the fixed target pressure condition corresponds to the maximum process gas discharge pressure condition. This gap causes higher than necessary work oil pressures that force the diaphragm 5 against the upper gas head 6 with more force and/or for a longer duration than necessary. If work oil pressure is reduced to match the current gas discharge pressure more closely, the life expectancy and fatigue resistance of the compressor 1, and particularly of diaphragm 5, may be increased as a result of lower amplitude equivalent stresses during the compressor's 1 discharge and suction cycles, as is illustrated in FIG. 9. For example, since the fixed relief valve 43 is fixed at a setting of 10-20% above the maximum process gas pressure regardless of the actual current process gas conditions, then the oil pressure within the compressor 1 reaches this maximum pressure condition each cycle to satisfy the overpump requirements during normal operation. In certain embodiments, when the relief setting is adjusted based on the current process gas conditions, the magnitude of the cyclic stress imparted on the compressors 1 may be reduced, and may extend machine life. Moreover, the compressor 1 will expend less energy pressurizing the work oil during current process gas conditions that are less than a target (maximum) process gas condition. Similarly, the compressor's 1 rod load is proportional to the work oil pressure set by the relief valve 43. If the oil relief setting on the relief valve 43 is actively adjusted, the maximum rod load experienced by the compressor 1 would adjust proportionally to the current process gas conditions and may therefore improve energy efficiency of the compressor 1. In certain embodiments, the process gas pressure conditions are measured via a pressure transducer. In these embodiments, the discharge gas pressure measurement may provide the feedback to control the relief valve's 43 pressure set point although other feedback methods may be used. In various embodiments, the relief setting is set to a pressure above the process gas condition by at least 1%, at least 2%, at least 5%, at least 10%, at least 25%, at least 50%, and at least 100%. In some embodiments, the relief setting is set to a pressure above the gas condition by about 1-5%, 1-10%, 1-20%, 5-10%, 5-20%, 5-30%, 5-50%, 10-20%, 10-30%, 10-50%. In other embodiments, the relief setting is set to a pressure above the process gas condition by at least 1 psi, at least 10 psi, about 1-10 psi, about 1-50 psi, about 1-100 psi, about 10-50 psi, about 10-100 psi, about 100-1,000 psi, about 1,000-1,500 psi, about 1,000-2,000 psi, and about 1,000-2,500 psi.

Figure 10:
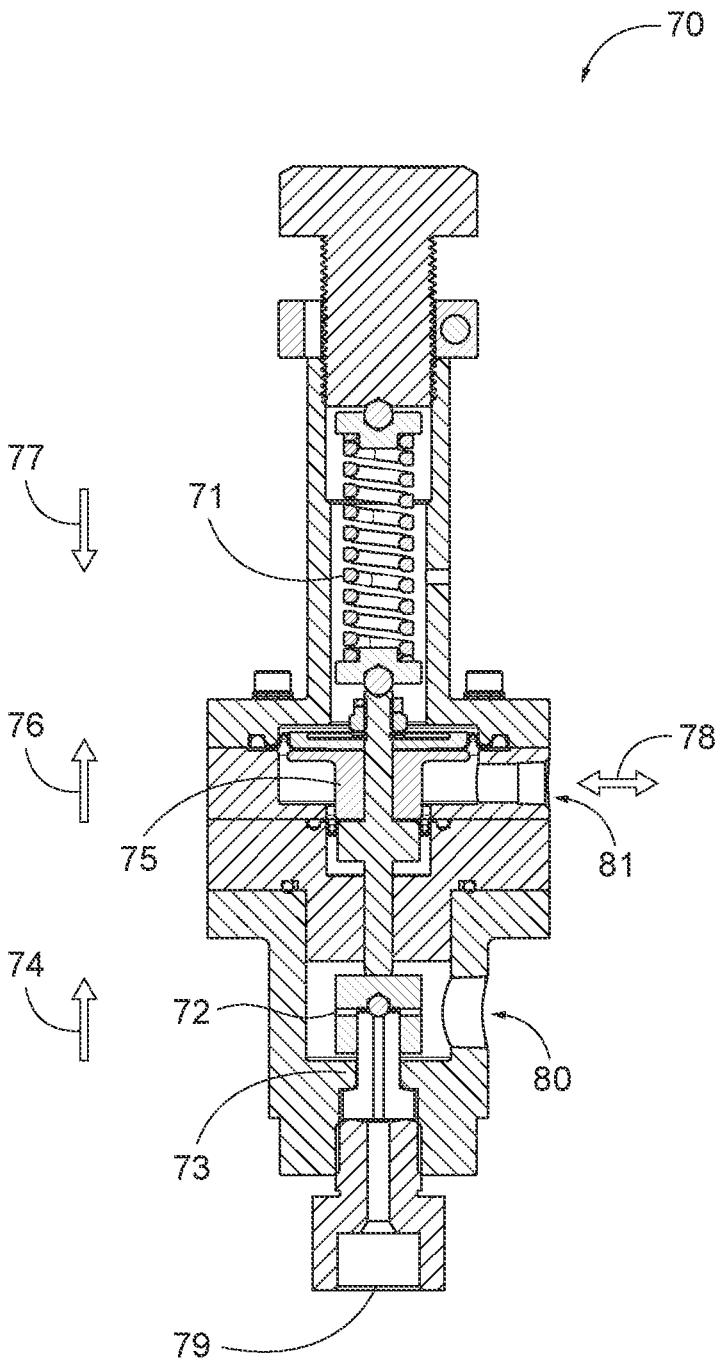
FIG. 10 is a side cross-sectional view of a valve according to embodiments of the present disclosure.

In certain embodiments, VPRV includes an actively controlled pneumatic pressure bias 78 to either aid or counteract an existing spring force 77 within the relief valve. FIG. 10 includes one embodiment of this force bias relief valve 70 that relieves high pressure work oil from valve inlet 79 to lower pressure storage, e.g. the crankcase of a crank-driven diaphragm compressor 1, via the valve outlet 80. During force bias relief valve 70 assembly, the force bias relief valve 70 spring 71 is compressed which forces the valve poppet 72 and valve seat 73 together resulting in a force balance within the force bias relief valve 70 between the spring force 77 and the seat force 74. This seat force 74 in combination with the valve's 70 seat 73 area (effective area) sets the hydraulic relief pressure of the force bias relief valve 70. The embodiment shown in FIG. 10 includes an internal piston 75 that allows for a bias force 76 to be applied within the force bias relief valve 70. In certain embodiments, when either hydraulic or pneumatic bias pressure 78 is applied to the internal piston 75 via the bias pressure inlet 81, the force from the internal piston 75 pushes against the spring force 77 which results in a lower seating force and thus a reduced pressure relief setting. In certain embodiments, by adjusting the bias force/pressure 76 within the force bias relief valve 70, the seating force 74 can be actively controlled allowing for a controlled pressure relief setting. In certain embodiments, the pressure bias 78 may be applied by the use of an I/P (current to pressure) transducer, for example. In other embodiments, multiple bias combinations that can be achieved with a spring 71 and internal piston 75 combination. In certain embodiments, the internal piston 75 could be oriented to either increase or decrease the force bias relief valve's 70 seating force 74 thus either increasing or decreasing the pressure relief setting as a bias pressure/force 78 is applied within the force bias relief valve 70.

In certain embodiments, the pressure relief valve 70 includes a valve spring 71 and an adjustable pneumatic pressure bias 78, the control valve 46 configured to actively adjust the hydraulic relief setting by adjusting the pneumatic pressure bias 78. One embodiment of the force bias relief valve 70 uses the process gas as an energy source for the bias force 76 via the bias pressure 78. In certain embodiments, the process gas is plumbed to a port on the VPRV such as bias pressure inlet 81 such that this gas pressure acts on the internal piston 75 to adjust the pressure relief setting. In other embodiments, hydraulic pressure from a hydraulic pressure source may be used as an energy source for the bias force 76 via the bias pressure 78. In still further embodiments, an electric actuator may be used as an energy source for the bias force 76 via the bias pressure 78. The actuator could be moved to adjust the pre load on the relief valve's 70 spring 71 thus changing the seating force 74 and pressure relief setting.

Figure 12:
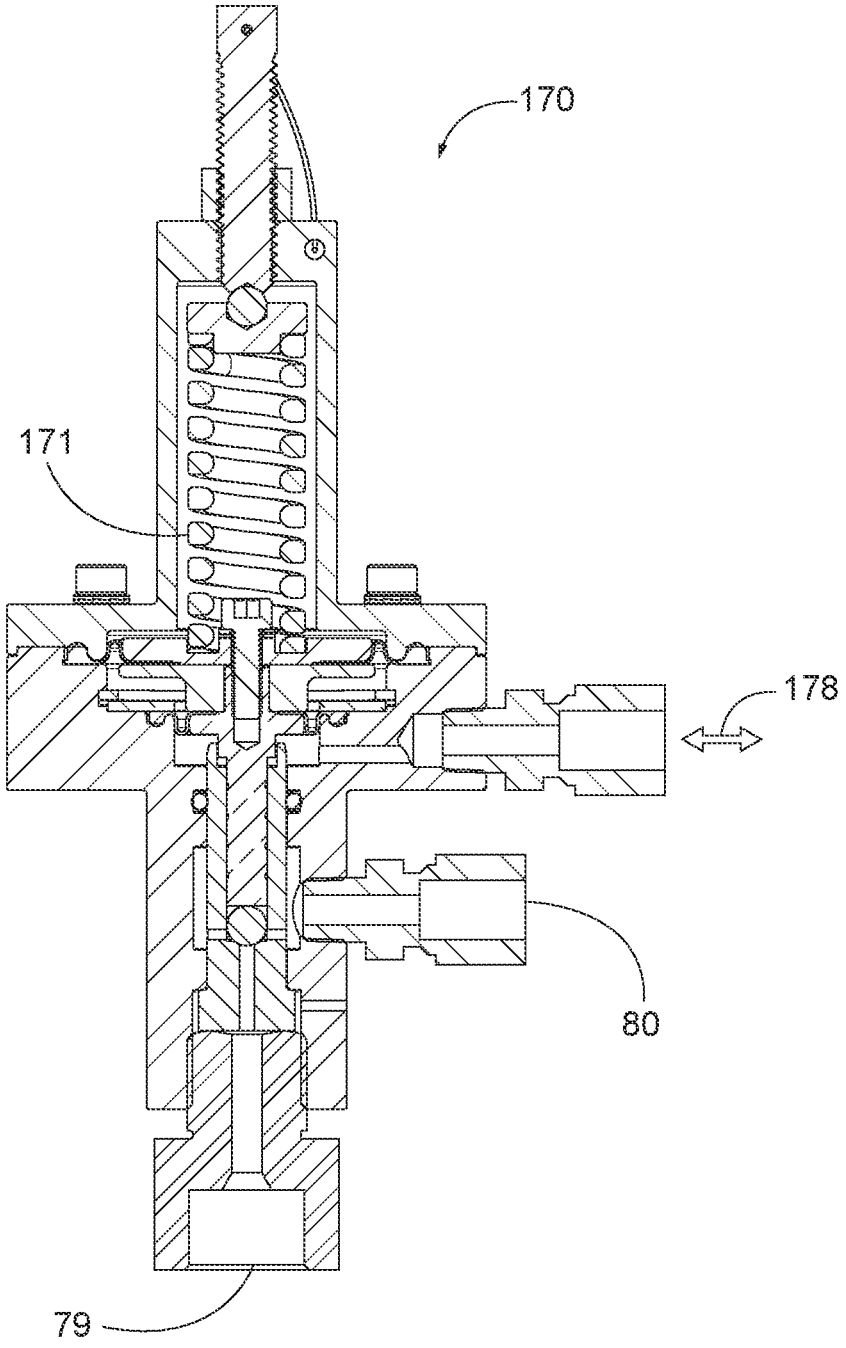
FIG. 12 is a side cross-sectional view of a valve according to embodiments of the present disclosure.

FIG. 12 illustrates another embodiment of a pressure relief valve 170 that may function similarly to the pressure relief valve 170. In certain embodiments, the pressure relief valve 170 includes a valve spring 171 and an adjustable pneumatic pressure bias 178, and the control valve 46 is configured to actively adjust the hydraulic relief setting by adjusting the pneumatic pressure bias 178.

Certain embodiments of the AOIS include an injector pump 40 and hydraulic accumulator 39 without a VPRV, while other embodiments include both systems.

In certain embodiments, during the compressor's 1 normal operation, a certain amount of overpump is required over the oil relief valve 14 to ensure the diaphragm 5 is making a complete sweep of the compressor volume 15 during each discharge cycle to maximize volumetric efficiency of the compressor 1. Certain embodiments include a feedback mechanism for measuring or inferring the amount of overpump out of the relief valve 43 during compressor 1 operation in order to control the injector pump 40 and motor 41 to produce the correct amount of flow into the compressor 1. In certain embodiments, the feedback mechanism includes primary feedback, i.e. a direct measurement of overpump. In other embodiments, primary feedback is enhanced by, or replaced with, indirect feedback, i.e. a measurement of some other parameter of the compressor 1 to indirectly infer a measurement of overpump.

Figure 4:
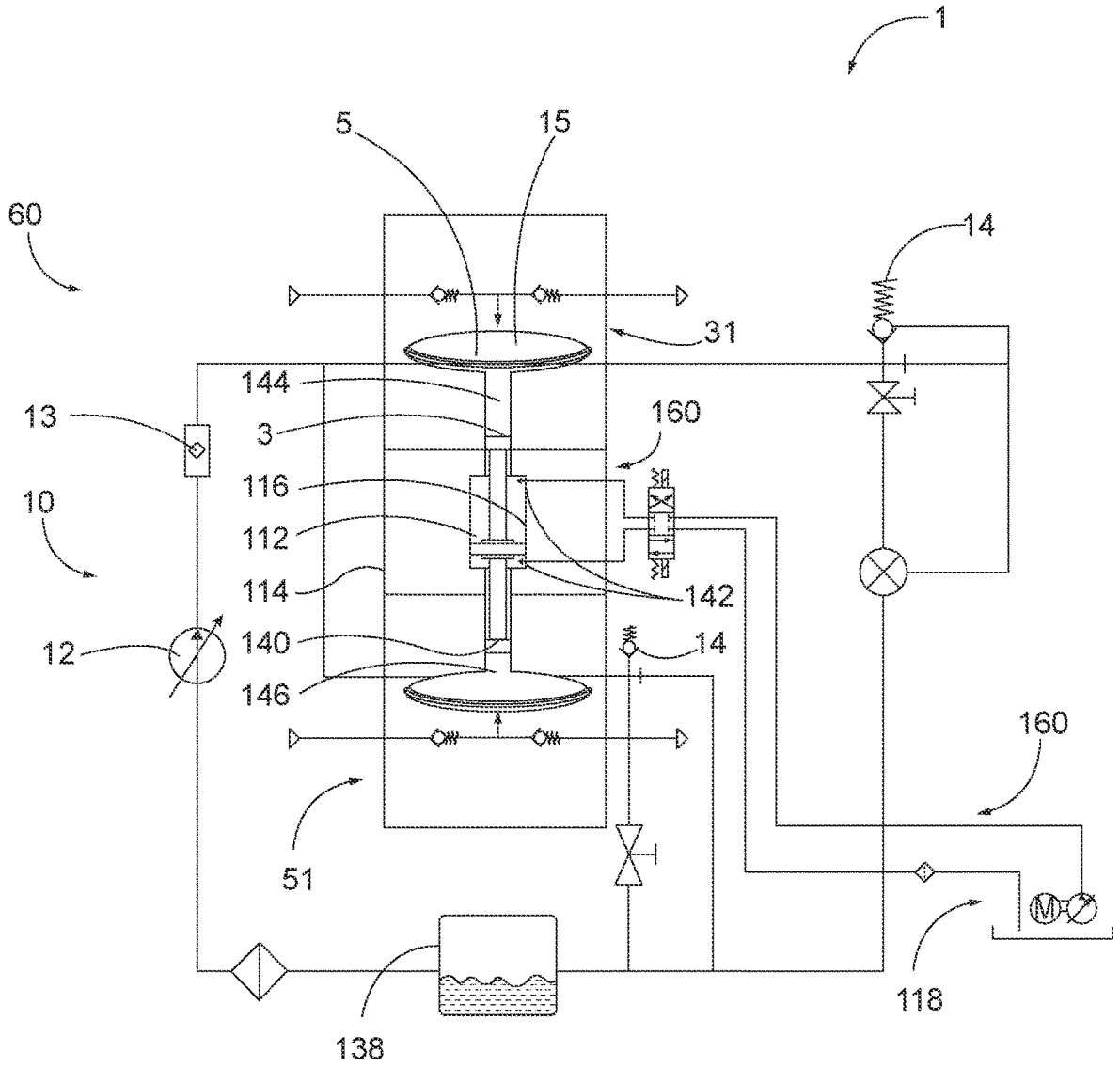
FIG. 4 is a schematic view of a hydraulically-driven diaphragm compressor with an injection pump system in accord with embodiments of the present disclosure.

As shown in FIG. 4, certain embodiments of the diaphragm compressor 1 include a first compressor head 31 and second compressor head 51, and a drive configured to intensify work oil and alternatingly provide intensified work oil to the first and second compressor heads 31, 51. In the embodiment of FIG. 4, the drive is a hydraulic drive 110. In some embodiments, the hydraulic drive 110 includes a first diaphragm oil piston 3 configured to intensify work oil against the first diaphragm 5, a second diaphragm oil piston 140 configured to intensify work oil against the second diaphragm 5 of the second compressor head 51, and an actuator 112 configured to power the first and second diaphragm oil pistons 3, wherein the first diaphragm oil piston 3 and the second diaphragm oil piston 3 are configured to alternatingly intensify the work oil in the respective first or second work oil region to an intensified pressure and thereby actuate the respective first or second diaphragm 5.

In certain embodiments, the compressor 1 also includes a hydraulic circuit 60 connecting the outlet 34 of the first compressor head 31 to the inlet 33 of the first compressor head 31 and connecting the outlet 34 of the second compressor head 51 to the inlet 33 of the second compressor head 31. In some embodiments, the hydraulic circuit 60 includes an oil reservoir 138 configured to collect overpumped work oil via the outlets 34 of the first and second compressor heads 31, 51. In other embodiments, the compressor 1 includes at least one hydraulic accumulator 39 (FIG. 6) configured to provide a supplemental supply of work oil to the inlets 33 of the first and second compressor heads 31, 51. In certain embodiments, each of the first and second compressor heads 31, 51 include a hydraulic accumulator 39. In some embodiments, the compressor 1 includes a pressure relief mechanism including a first pressure relief valve 43 in communication with the outlet 34 of the first compressor head 31 and configured to relieve the pressurized work oil from the first work oil region 35, the first pressure relief valve 43 comprising a first hydraulic relief setting corresponding to a first target condition of the pressurized work oil relative to the process gas discharge pressure in first compressor head 31, the first pressure relief valve 43 configured to actively adjust the hydraulic relief setting to correspond to a first current condition of the process gas in first compressor head 31. These embodiments may also include a second pressure relief valve 43 in communication with the outlet 34 of the second compressor head 51 and configured to relieve the pressurized work oil from the second work oil region, the second pressure relief valve 43 comprising a second hydraulic relief setting corresponding to a second target condition of the pressurized work oil relative to the process gas discharge pressure in second compressor head 51, the second pressure relief valve 43 configured to actively adjust the second pressure relief valve 43 to correspond to a second current condition of the process gas in second compressor head 51. In some embodiments, the first target condition and the second target condition may be different, corresponding to different conditions in the first head and the second head, and in other embodiments, they may be the same. In further embodiments, the first current condition and the second current condition may be different, corresponding to different conditions in the first head and the second head, and in other embodiments, they may be the same.

In some embodiments, the compressor 1 includes a feedback mechanism configured to control an injector pump 40 to maintain the first and second target conditions, or first and second current conditions, the feedback mechanism including one or more measurement devices 44 configured to sense or measure a current condition of the intensified work oil flowing out one or more of the first compressor head 31 and the second compressor head 51, and wherein the feedback mechanism is configured to adjust the volumetric displacement of the injector pump 40 in response to both the first current condition and the second current condition.

In some embodiments, the hydraulic relief setting of the first pressure relief valve 43 and second pressure relief valve 43 is a fixed value corresponding to the first target condition and second target condition being above a predetermined process gas discharge pressure as discussed herein. In other embodiments, the first pressure relief valve 43 and second pressure relief valve 43 are variable, the pressure relief mechanism 42 further including a first control valve 46 configured to actively adjust the hydraulic relief setting of the first pressure relief valve 43 to correspond to the first current condition, and a second control valve 46 configured to actively adjust the hydraulic relief setting of the second pressure relief valve 43 to correspond to the second current condition, wherein the first current condition and the second current condition are above a process gas discharge pressure as discussed herein.

In some embodiments such as FIG. 4, the compressor 1 includes a hydraulic drive 110 comprising a hydraulic actuator, the hydraulic drive including an actuator housing 114 comprising a drive cavity 116 extending between the first and second compressor heads 31, 51. In some embodiments, the drive cavity 116 includes one or more inlets 142 for work oil at one or more drive pressures. In other embodiments, the first diaphragm oil piston 3 defines a first variable volume region 144 between the first diaphragm oil piston 3 and the diaphragm 5 of the first compressor head 31, and the second diaphragm oil piston 3 defines a second variable volume region 146 between the second diaphragm oil piston 3 and the diaphragm 5 of the second compressor head 51.

In certain embodiments, the AOIS includes a feedback mechanism configured to control the injector pump 40 to maintain the target condition or the current condition of the work oil region 35. The feedback mechanism includes a measurement device 44 that provides feedback to verify the current condition is being met to control the injector pump system 30. In certain embodiments, the feedback mechanism includes a first measurement device 44 operatively coupled to the diaphragm compressor 1, the measurement device 44 configured to detect and/or measure the overpump current condition of the volumetric flow of intensified work oil flowing out of the outlet 34 from the work oil region 35. In other embodiments, the measurement device 44 is operatively coupled to another section of the hydraulic circuit 60, the discharged process gas, or the drive, such embodiments providing indirect feedback whereby a controller can infer the overpump current condition based on the measurement device. In any embodiment, the measurement device 44 may comprise a plurality of measurement devices at one or more locations. In certain embodiments, the feedback mechanism is configured to adjust the volumetric displacement of the injector pump 40 to the hydraulic accumulator 39 in response to the overpump current condition. In some embodiments, the first measurement device 44 of the feedback mechanism includes one or more of: a flow meter downstream of the outlet 34, a position sensor in the pressure relief valve 43, and a pressure transducer with a temperature transducer each located downstream of the pressure relief valve 43.

In one embodiment, the feedback mechanism includes a direct feedback mechanism including a flowmeter downstream of the relief valve outlet 80, and between a hydraulic tank, oil reservoir 38 or 138, or crankcase. In certain embodiments, the flow meter may include a positive displacement flow meter, turbine flow meter, ultrasonic flow meter, a sensor measuring change in pressure over an orifice plate, or Coriolis flow meter.

In some embodiments, a flowmeter may include a pulse-output. In certain of these embodiments, flow may be calculated based on a moving average based on time. In this method, a new moving average may be calculated at a constant time interval—a flowrate may be updated periodically, but large flowrate changes may be detected more slowly than other options. In further embodiments, the flow may be calculated by a moving average based on number of pulses—this method may calculate a new moving average after a specific number of pulses have been read from the flowmeter. This method may work well in high flowrate and increasing flowrate conditions, because the moving average will be updated more often due to the flowmeter reporting more pulses. However, in low flowrate and decreasing flowrate conditions, this method may not update as fast, or at all if the flowmeter stops reporting pulses. This could potentially delay the controller's response to a decreasing flowrate. In still further embodiments, the flow may be calculated by a hybrid method of time and pulses—with this method, a new moving average may be computed based on either time or flowrate or both, and whichever condition is satisfied first will trigger a new flowmeter average. This method may allow for a pulse-based method to be used at higher flowrates and a time-based method to be used at lower flowrates.

In other embodiments, the feedback mechanism includes an indirect feedback mechanism including an oil relief valve 43 that includes position feedback of e.g. the valve seat 73 to monitor the valve's trajectory, i.e. the position and/or duration of the opening of the valve seat 73, during a relief event. Monitoring valve trajectory may enable a control system to indirectly measure the amount of fluid that was relieved during a relief event. This measurement of valve trajectory could include a direct analog or digital position measurement or an electrical continuity measurement between the valve poppet 72 and valve seat 73, among other options. In certain embodiments, the sensor may include a hall effect, LVDT, magnetoresistive, or optical sensor, to monitor the valve's trajectory.

In certain embodiments, a sensor measuring a continuous position measurement of the oil relief valve 14 position may include at least one of an analog hall effect sensor, an ultrasonic displacement sensor, an optical sensor (for example, laser doppler vibrometer, or other), a linear variable differential transformer (LVDT), a capacitive displacement sensor, and an eddy-current sensor. In other embodiments, a sensor measuring two valve positions of the oil relief valve 14 (i.e. open vs. closed) may include at least one of an optical proximity sensor, a contact switch, and a digital hall effect sensor.

In another embodiment, the feedback mechanism includes an indirect feedback mechanism including monitoring the pressure dynamics downstream of the relief valve 43. In some embodiments, the pressure and temperature of the hydraulic fluid may be monitored to measure pressure spikes that occur during each relief event to infer flow rate though the relief valve 43.

In certain embodiments, the feedback mechanism may include an I/P pneumatic pressure transducer on the pneumatic line between the I/P transducer and VPRV, which may be used to measure the bias pressure applied to the VPRV.

In still further embodiments, the feedback mechanism includes an indirect feedback mechanism including monitoring the pressure within the compressor 1. In these embodiments, if the hydraulic pressure within the compressor 1 does not reach the oil relief valve 43 setting, there may not be enough oil in the compressor 1 and the overpump condition may not be satisfied.

Figure 11:
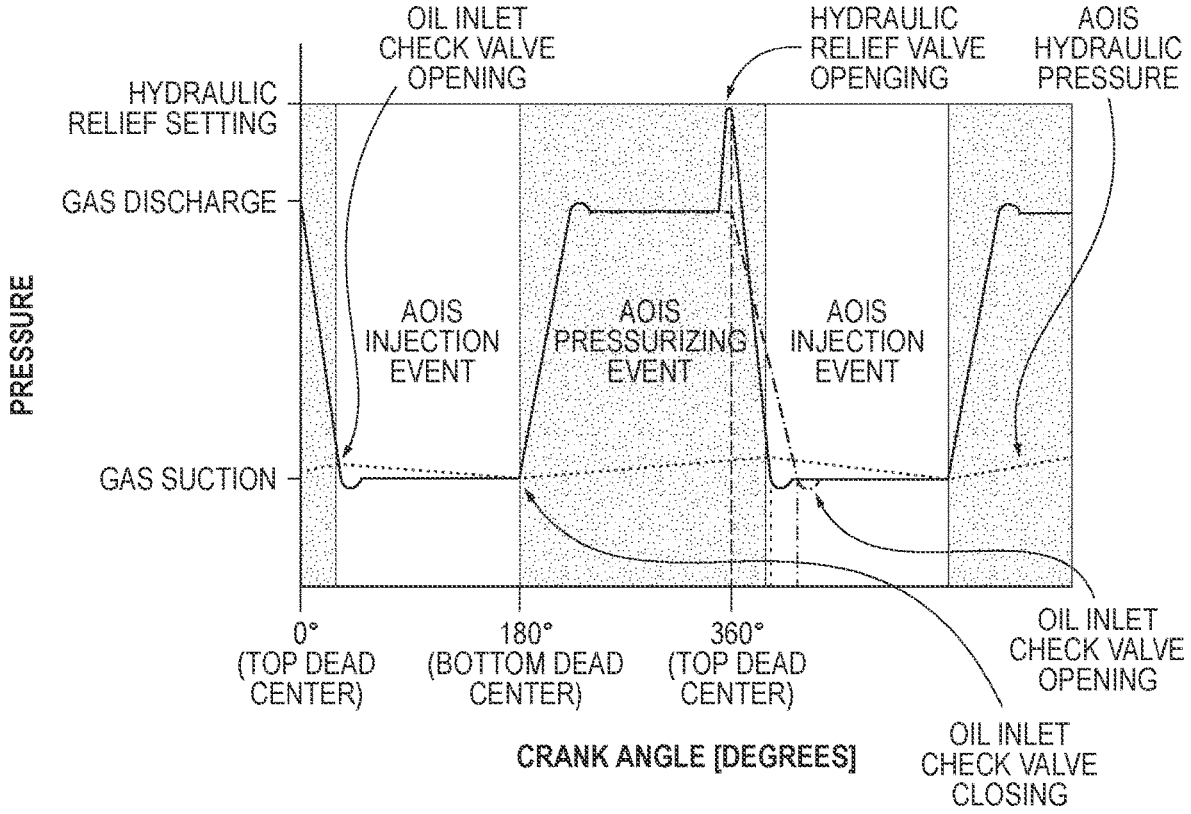
FIG. 11 is a pressure graph.

In a further embodiment, the feedback mechanism includes an indirect feedback mechanism including monitoring the pressure in the hydraulic accumulator 39. In certain of these embodiments, the pressure is measured by a pressure transducer or inferred from a compressor 1 motor 41 torque measurement (based on a model or look-up tables), or a pressure transducer in the hydraulic volume. In these embodiments, if the pressure within the hydraulic accumulator 39 is significantly lower than the pressure within the work oil region 35, this could be an indication the AOIS is not injecting fluid into the compressor 1. In other embodiments, if the diaphragm 5 begins to contact the process gas head support plate 8, cavitation and voiding may occur within the compressor 1. Any cavitation or voiding events within the compressor 1 may significantly reduce the pressure within hydraulic accumulator 39. In some embodiments, during normal operation, the hydraulic pressure at inlet 33 may be very close to the process gas suction pressure. If the hydraulic pressure in hydraulic accumulator 39 drops significantly, it may be inferred the diaphragm 5 has hit the work oil head support plate 8 and the AOIS system 30 needs to provide more flow until the AOIS pressure is regained. Additionally, if the oil relief setting of the oil relief valve 14 is not reached during a discharge cycle, this may impact when the hydraulic accumulator 39 volume begins to flow into the compressor 1 as illustrated in FIG. 11. In some embodiments, these conditions could be measured to monitor if the overpump condition is being satisfied or if cavitation is occurring within the compressor 1 on a cycle to cycle basis.

In a further embodiment, the feedback mechanism includes an indirect feedback mechanism including measuring process gas temperature and pressure to infer the amount of annular leakage that is occurring during operation. In some embodiments, based on these measurements, a model based adaptive controller may be implemented to control the AOIS injector pump 40 to satisfy the overpump requirements. In these embodiments, process gas pressure may be measured by one of suction, interstage, and outlet pressure, and the gas pressure within the cavity 15. In certain embodiments, these measurements may be raw or filtered. In other embodiments, annular leakage may be measured directly by a flowmeter of the type discussed herein, or the catch and weigh method.

In a further embodiment, the feedback mechanism includes a direct feedback mechanism including physically capturing the overpump through the relief valve 43 and measuring the amount of oil that has been captured. In some embodiments, this measurement could be monitored on a time-based scale, among others, to calculate flow rates through the relief valve.

In a further embodiment, the feedback mechanism includes an indirect feedback mechanism including monitoring motor current of an electric motor of the compressor 1. In these embodiments, if the hydraulic oil relief setting produces additional torque requirements from the motor each cycle, the motor current could be monitored to ensure these pressure spikes are occurring each cycle and the overpump condition is being satisfied.

In still other embodiments, a sensor may monitor the AOIS system 30 injector pump 40 motor 41 torque and speed, including by at least one of motor 41 current measurement, reported torque from motor drive (variable frequency drive or other), and the motor 41 speed may be measured by at least one of a rotary encoder and reported speed from motor 41 drive (variable frequency drive or other).

In further embodiments, the flowrate of hydraulic fluid through the injector pump 40 including a method of at least one of determining from motor 41 speed and displacement, and a flowmeter (positive displacement, turbine, or other).

In certain embodiments, a sensor may monitor the state of process gas valves by at least one of measuring feedback from valves, process gas pressure, and a signal from process gas control subsystem.

In further embodiments, a sensor may measure the temperature of the hydraulic fluid at any point in the AOIS, including at least the use of a thermocouple, thermistor, and resistance temperature detector (RTD).

Turndown ratio refers to the width of the operational range of a device, and is defined as the ratio of the maximum capacity to minimum capacity. In certain embodiments of the active oil injection system, the oil injection system is configured to provide a turndown ratio relative to the primary work oil in the work oil region 35. In other embodiments, the maximum capacity can satisfy the target condition, and the minimum capacity is zero volumetric flow. By separating the functions of the drive and the injector pump 40, a large turndown ratio can be achieved allowing for adjustability of injection quantity when compared to the previous non-adjustable crank driven injection pump system 10. When the injector pump 40 is mechanically linked to the drive, e.g. in a crank-driven compressor 1, the compressor's 1 RPM is constant during normal operation, which does not allow for volumetric displacement adjustability. However, the large turn down ratio of an independent AOIS allows for a highly variable injection quantity to tightly control the amount of overpump through the relief valve 43 over a wide range of operating conditions, from zero volumetric flow, to flow corresponding to a current condition, to flow corresponding to a target or maximum condition.

Certain embodiments herein may include control system variants for the AOIS. In some embodiments, feedback may be used to control the flowrate from the hydraulic accumulator 39. Under this control strategy, the overpump of work oil out of the compressor head 31 and through the VPRV 70 will be measured or derived from other sensor inputs. Some form of a PID controller may be used to adjust the injector pump 40 and/or motor 41 speed based on the measured flowrate. In some embodiments, the desired overpump may be derived from a model, from a look-up table, or from operator input. In some embodiments, the flowrate measurement may be raw or filtered. In certain embodiments, during start-up operation of the compressor 1, normal flow rates are not expected as the hydraulic accumulator 39 and compressor head 31 are primed with work oil. As a result, the flowrate measurement may not be used for feedback until a specified time has elapsed or until consistent flowrate measurements are obtained.

Other embodiments may use feedforward control from annular leakage model. In these embodiments, the process gas outlet pressure and oil temperature may be used to predict an annular leakage rate. The injector pump 40 and/or motor 41 speed may be adjusted such that the injector pump 40 output is equal to the sum of the predicted annular leakage and desired overpump out of the compressor head 31. In these embodiments, the annular leakage rate may be determined from a model, a look-up table, or from operator input, and the desired over injector pump 40 may be derived from a model, from a look-up table, or from operator input. In these embodiments, there are some variables that may not be accounted for in the annular leakage model and may not be able to be measured by sensors, such as eccentricity of the oil piston 3. As a result, the predicted annular leakage may have an error associated with it, which may be difficult to account for without an additional form of feedback. Therefore, in some embodiments this variant could be used in conjunction with the flowrate measurement discussed herein as a bias for the feedback controller.

Certain embodiments may employ model-reference adaptive control, wherein the annular leakage model would be used to predict the annular leakage across the oil piston 3. In these embodiments, process gas outlet pressure and hydraulic fluid temperature may be measured to predict the annular leakage. In these embodiments, the overpump flowrate would be used to provide feedback of the overpump of work oil out of the compressor head 31. The flowrate may be compared to the expected overpump predicted by the model and adjustments to the model may be made to account for this error. In these embodiments, the flowrate measurement may be raw or filtered. In some embodiments, parameters in the annular leakage model may be adjusted such that the predicted overpump from the model matches the measured flowrate.

Other embodiments may employ feedback control of I/P transducer, where a pressure transducer may be used to measure the pneumatic pressure output of the I/P transducer, which may converts an analog electrical signal into a pneumatic pressure output used as the bias pressure for the VPRV. In these embodiments, the pressure measurement may be raw or filtered. In some embodiments, the pressure output of the I/P transducer may be compared to the desired pressure output of the I/P transducer. In these embodiments, the I/P transducer command may be adjusted to reduce the error between the actual and desired pneumatic pressure output of the I/P transducer. In further embodiments, the desired pressure output of the I/P transducer may be derived from a model, from a look-up table, or from operator input.

Certain embodiments may employ feedback from process gas control subsystem, where for the AOIS, feedback from the process gas control subsystem can be used during gas loading and unloading processes. In these embodiments, during gas loading, the process gas interstage and outlet pressures may increase rapidly. If feedback control of the injection pump motor 41 uses flowmeter feedback, the time delay between the decreased actual flowrate across the flowmeter and decreased measured flowrate across the flowmeter may be too great for the injection pump motor 41 to be able to catch up and provide enough flowrate to account for annular leakage and the desired overpump. In these embodiments, if the process gas control subsystem actuates a valve as part of the gas loading process, the state of this valve can be monitored and reacted to accordingly. In one example, if the valve is actuated as part of a gas loading process, the AOIS control system can transition from a steady-state control state to a gas loading state. In this gas loading state, the injection pump motor 41 speed may be commanded to its maximum speed to account for the increased in annular leakage. In these embodiments, the process gas pressure transducers and flowmeter measurements may be used to determine when the gas loading process is completed and the AOIS control system will transition back to a steady-state control state. In some embodiments, during gas loading, the VPRV may also need to be adjusted quickly to prevent hydraulic fluid in the compressor cavity 15 being pumped out over the relief valve 43. When the AOIS control system is in a gas loading state, the VPRV bias pressure 78 can be reduced based on the incoming process gas pressure. In still further embodiments, during gas unloading, the process gas suction and outlet pressure may decrease rapidly. If the process gas control subsystem actuates a valve as part of the gas unloading process, the state of this valve can be monitored and reacted to accordingly. When the valve is actuated to start a gas unloading process, the AOIS control system may transition from a steady-state control state to a gas unloading control state. During the gas unloading state, the injection pump motor 41 speed may be decreased to decrease the amount of hydraulic fluid overpump over the relief valve 43. When the gas unloading process is complete, e.g. determined by pressure or flowrate measurements, the AOIS control system may return to a steady-state control state.

Certain embodiments may employ feedback from a work oil region 35 pressure transducer. In these embodiments, the AOIS injector pump 40 pumps fluid into a hydraulic accumulator 39, which may be connected to the inlet 33 of the compressor head 31. Under normal operating conditions, the pressure of this hydraulic accumulator 39 may be similar to the process gas inlet pressure and it will increase during a compressor 1 exhaust stroke (when the inlet check valve 9 to the compressor head 31 is closed). In these embodiments, if the pressure of the hydraulic accumulator 39 drops below a threshold pressure, the hydraulic accumulator 39 is not receiving enough fluid from the injector pump 40 and the compressor diaphragm 5 is at risk of hitting the hydraulic head 8 of the compressor 1. In this scenario, the AOIS injector pump 40 speed may be increased to prevent the diaphragm 5 from hitting the hydraulic head 8. In some embodiments, the threshold pressure may be derived from a model, a look-up table, or operator input. In other embodiments, the pressure measurement may be filtered or it may be raw.

Some embodiments may employ feedback from relief valve 43 position, where the overpump of work oil out of the compressor head 31 and through the VPRV 70 will be measured. In these embodiments, some form of a PID controller may be used to adjust the variable volumetric flow of work oil based on the measured flowrate. In these embodiments, the desired over pump may be derived from a model, from a look-up table, or from operator input. In these embodiments, the flowrate measurement may be raw or filtered. In some embodiments, during start-up operation of the compressor 1, normal flow rates are not expected as the hydraulic accumulator 39 and compressor head 31 are primed with work oil. As a result, the flowrate measurement may not be used for feedback until a specified time has elapsed or until consistent flowrate measurements are obtained.

Still further embodiments may employ feedback from a relief valve 43 open/close switch. In some embodiments, the timing of the relief valve 43 opening will be compared to a desired timing of the relief valve 43 opening. If the actual open/close time does not match the desired timing, adjustments to the system, such as the AOIS injector pump 40 speed, may be made. In these embodiments, the desired timing may be derived from a model, a look-up table, or from operator input.

Other embodiments may include other prognostic or diagnostic functions of the AOIS. Some embodiments may employ pressure measurement of I/P transducer output, and may include measuring the pneumatic pressure output of the I/P transducer, which may allow for any failure in the I/P transducer to be detected. In some embodiments, in the case that the I/P transducer pressure output is higher than commanded, the VPRV 70 cracking pressure will be lower than desired, and the work oil in the work oil region 35 is at risk of draining out of the work oil region 35 quickly. In this scenario, the I/P transducer may be disabled, which may cause the pressure output to be 0 psi and the VPRV cracking pressure will return to its baseline setting since no bias pressure 78 is applied. In some embodiments, the higher than commanded I/P pressure output is indicative of a malfunction of the I/P transducer and may alert the operator. In some embodiments, in the case that the I/P pressure output is lower than commanded, the VPRV cracking pressure may be higher than desired, which may decrease the efficiency of the system and may increase the magnitude of the cyclic stress on compressor 1 components. The lower than commanded I/P pressure output may be indicative of a malfunction of the I/P transducer and may alert the operator.

Certain embodiments may monitor the flowrate of overpump, where in addition to the flow measurement feedback that the flowmeter provides to the control system, it can also be used to monitor the system's overall health and functionality. In these embodiments, during a start-up condition when the compressor 1 is not fully primed, the flow meter can be used to provide feedback that hydraulic fluid is flowing out of the compressor cavity 15. After a specified duration of consistent flow measurements, the priming process may be flagged as complete and the compressor 1 can continue with normal operation. In other embodiments, during normal operating conditions, the flow measurement may be used to set both warning and fault flags if the flow measurement is lower than expected. For example, a flow measurement that is lower than expected for a short duration may be caused by an insufficient control strategy and may only warrant a warning to the operator. In a more severe case where the flow measurement is below a lower threshold or if a low flow measurement is recorded for an extended duration, then a fault flag may be set and the compressor 1 system may be shut down.

Some embodiments may monitor for excessive annular leakage, where the annular leakage model may be used to predict the leakage of hydraulic fluid over the oil piston 3. If the measured overpump from the flowmeter is less than the predicted overpump and the adjustable parameters, such as radial clearance and eccentricity, in the annular leakage model are at their limits, then the control system may alert the operator with a warning. This warning may be indicative of excessive compressor 1 wear or other mechanical wear/failure that may be addressed.

Certain embodiments may monitor for motor 41 torque levels being out of bounds, where excessive motor 41 torque may be indicative of a blocked hydraulic line and may alert the operator with a warning or fault depending on the deviation of motor 41 torque from expected. In some embodiments, motor 41 torque below a certain threshold may be indicative of a leak or ruptured hydraulic line and may alert the operator with a warning or fault depending on the deviation of motor 41 torque from expected.

Some embodiments may monitor the hydraulic pressure in hydraulic accumulator 39, where in addition to using the hydraulic pressure as a potential control method, it can also be monitored for diagnostics. If the pressure in the hydraulic accumulator 39 drops below a threshold value, the injector pump 40 is not supplying enough work oil. In these embodiments, the threshold value may be derived from a model, a look-up table, or from operator input.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. An active oil injection system in a diaphragm compressor, comprising:

a diaphragm compressor comprising:

a compressor head comprising:

a work oil head support plate and a process gas head support plate defining a diaphragm cavity therebetween, the work oil head support plate comprising a piston cavity, an inlet, and an outlet, and a metallic diaphragm mounted between the work oil head support plate and the process gas head support plate, the metallic diaphragm dividing the diaphragm cavity into a work oil region and a process gas region, the work oil region being in separate communication with each of the piston cavity, the inlet, and the outlet, wherein the metallic diaphragm is configured to actuate from a first position proximate the work oil head support plate to a second position proximate the process gas head support plate to pressurize process gas in the process gas region to a process gas discharge pressure, a drive configured to intensify and supply primary work oil to the compressor head, the drive comprising:

a drive cavity extending from the compressor head and in communication with the work oil region via the piston cavity, a piston mounted in the drive cavity and defining the volume of the work oil region, and an actuator configured to power the piston, wherein, during a discharge cycle, the drive is configured to power the piston to move toward the compressor head to intensify primary work oil in the work oil region from a first pressure to an intensified pressure and thereby actuate the metallic diaphragm to the second position;

a hydraulic circuit connecting the outlet of the work oil head support plate to the inlet of the work oil head support plate, the hydraulic circuit comprising:

an oil reservoir configured to collect overpumped work oil from the work oil region via the outlet of the work oil head support plate, a hydraulic accumulator configured to provide a supply of supplemental work oil to the inlet of the work oil head support plate, an injector pump in communication with the hydraulic accumulator, the injector pump configured to produce a variable volumetric displacement of the supplemental work oil from the oil reservoir to the hydraulic accumulator, the injector pump comprising:

a pump operatively coupled to the hydraulic accumulator, and a pressure relief mechanism operatively coupled to the work oil region of the diaphragm cavity, the pressure relief mechanism comprising:

a pressure relief valve in communication with the outlet of the work oil head support plate and configured to relieve the pressurized work oil from the work oil region, the pressure relief valve comprising a hydraulic relief setting corresponding to a target pressure condition of the pressurized work oil relative to the process gas discharge pressure, and a control valve configured to actively adjust the hydraulic relief setting of the pressure relief valve based on a current condition of the process gas; and a feedback mechanism configured to control the injector pump, the feedback mechanism comprising:

a first measurement device operatively coupled to one or more of the outlet and the pressure relief valve, the first measurement device configured to detect a current condition of the pressurized work oil flowing through the pressure relief valve from the work oil region, the first measurement device of the feedback mechanism comprising one or more of a flow meter downstream of the outlet, a position sensor in the pressure relief valve, and a pressure transducer located downstream of the pressure relief valve, and wherein the feedback mechanism is configured to adjust the volumetric displacement of the injector pump to the hydraulic accumulator in response to the detected current condition.

2. The active oil injection system of claim 1, wherein the hydraulic relief setting is a pressure of at least 10-20% above a measured process gas discharge pressure.

3. The active oil injection system of claim 1, wherein the oil reservoir is in fluid communication with the drive of the diaphragm compressor;

wherein the actuator of the diaphragm compressor is a crank-slider mechanism, and the oil reservoir is a crankcase of the crank-slider mechanism;

wherein the hydraulic circuit further comprises:

an inlet check valve operatively coupled to the inlet of the work oil head support plate, the inlet check valve configured to prevent backflow from the work oil region to the hydraulic accumulator, and an outlet check valve operatively coupled to the outlet of the work oil head support plate, the outlet check valve configured to prevent backflow from the hydraulic circuit to the work oil region;

wherein, during a suction cycle of the diaphragm compressor at the compressor head, the drive of the diaphragm compressor is configured to move the piston away from the compressor head to depressurize the work oil region and thereby pull the metallic diaphragm to the first position, and wherein, during the suction cycle, the hydraulic accumulator is configured to supply an injection volume of the supplemental work oil to the inlet of the work oil head support plate.

4. The active oil injection system of claim 3, wherein the injection volume from the hydraulic accumulator corresponds to the volume of overpump flow of pressurized work oil through the pressure relief valve; wherein the injector pump is configured to charge the hydraulic accumulator during both the discharge and suction cycles of the diaphragm compressor.

5. The active oil injection system of claim 1, the injector pump further comprising a motor configured to drive the pump independently from the drive, the pump and motor of the injector pump comprising a pump and motor selected from one of: a variable speed motor with a fixed displacement hydraulic pump, a fixed speed motor with a variable displacement hydraulic pump, and a variable speed motor with a variable displacement hydraulic pump.

6. The active oil injection system of claim 1, the hydraulic circuit further comprising a metering actuator operatively coupled to the inlet, the metering actuator configured to inject the supplemental work oil selectively during each of a suction cycle and the discharge cycle of the diaphragm compressor.

7. The active oil injection system of claim 1, the pressure relief valve comprising a valve spring and an adjustable pneumatic pressure bias, the control valve configured to actively adjust the hydraulic relief setting by adjusting the pneumatic pressure bias.

8. The active oil injection system of claim 1, wherein the pressure transducer located downstream of the pressure relief valve comprises a pressure transducer with a temperature transducer each located downstream of the pressure relief valve.

9. The active oil injection system of claim 1, further comprising a hydraulic power unit driving the actuator of the diaphragm compressor; wherein the hydraulic power unit comprises a second hydraulic circuit of oil that is separate from the work oil of the hydraulic circuit of the active oil injection system.

10. The active oil injection system of claim 9, wherein the oil reservoir is a hydraulic tank operatively coupled with the hydraulic power unit, the injector pump comprising an active control valve configured to selectively isolate the injector pump from the hydraulic power unit of the diaphragm compressor.

11. The active oil injection system of claim 1, the drive of the diaphragm compressor comprising a hydraulic drive supplied by a plurality of pressure rails configured to supply work oil to power the piston, the plurality of pressure rails comprising:

a low-pressure rail supplying low-pressure work oil via a passive first valve, a medium-pressure rail supplying medium-pressure work oil via an active second valve, and a high-pressure rail supplying high-pressure work oil via an active third valve;

wherein the drive of the diaphragm compressor further comprising a hydraulic power unit providing the supply of work oil to the medium-pressure rail and the high-pressure rail, the hydraulic power unit comprising a hydraulic pump and motor.

12. An active oil injection system in a diaphragm compressor, comprising:

a diaphragm compressor comprising:

a first compressor head comprising:

an inlet, an outlet, a first head cavity, and a first diaphragm dividing the first head cavity into a first work oil region and a process gas region, the first diaphragm configured to actuate to pressurize process gas in the process gas region, a second compressor head comprising:

an inlet, an outlet, a second head cavity, and a second diaphragm dividing the second head cavity into a second work oil region and a process gas region, the second diaphragm configured to actuate to pressurize process gas in the process gas region, a drive configured to intensify work oil and alternatingly provide intensified work oil to the first and second compressor heads, the drive comprising:

a first diaphragm piston configured to intensify work oil against the first diaphragm, a second diaphragm piston configured to intensify work oil against the second diaphragm, and an actuator configured to power the first and second diaphragm pistons, wherein the first diaphragm piston and the second diaphragm piston are configured to alternatingly intensify the work oil in the respective first or second work oil region to an intensified pressure and thereby actuate the respective first or second diaphragm;

a hydraulic circuit connecting the outlet of the first compressor head to the inlet of the first compressor head and connecting the outlet of the second compressor head to the inlet of the second compressor head, the hydraulic circuit comprising:

an oil reservoir configured to collect overpumped work oil via the outlets of the first and second compressor heads, a hydraulic accumulator configured to provide a supplemental supply of work oil to the inlets of the first and second compressor heads, an injector pump in communication with the hydraulic accumulator, the injector pump configured to produce a variable volumetric displacement of supplemental work oil from the oil reservoir to the hydraulic accumulator, the injector pump comprising:

a pump operatively coupled to the hydraulic accumulator, a pressure relief mechanism comprising:

a first pressure relief valve in communication with the outlet of the first compressor head and configured to relieve an overpump of the pressurized work oil from the work oil region, the first pressure relief valve comprising a hydraulic relief setting corresponding to a first target pressure condition of the pressurized work oil relative to the process gas discharge pressure, a first control valve configured to actively adjust the hydraulic relief setting of the first pressure relief valve based on the current condition of the discharged process gas, a second pressure relief valve in communication with the outlet of the second compressor head and configured to relieve an overpump of the pressurized work oil from the work oil region, the second pressure relief valve comprising a hydraulic relief setting corresponding to a second target pressure condition of the pressurized work oil relative to the process gas discharge pressure, a second control valve configured to actively adjust the hydraulic relief setting of the second pressure relief valve based on the current condition of the discharged process gas; and a feedback mechanism configured to control the injector pump, the feedback mechanism comprising:

one or more measurement devices configured to measure the current condition of the pressurized work oil flowing through one or more of the first and second pressure relief valves from the one or more first work oil region and the second work oil region, the one or more measurement devices of the feedback mechanism comprising one or more of a flow meter downstream of the outlet of one or more of the first compressor head and the second compressor head, a position sensor in the pressure relief valve, and a pressure transducer located downstream of the pressure relief valve, and wherein the feedback mechanism is configured to adjust the volumetric displacement of the injector pump in response to the current condition of the pressurized work oil flowing through the pressure relief valve from the first work oil region and the second work oil region.

13. An active oil injection system in a hydraulically powered diaphragm compressor, comprising:

a hydraulically powered diaphragm compressor comprising:

a first compressor head comprising:

an inlet, an outlet, a first head cavity, and a first diaphragm dividing the first head cavity into a first work oil region and a process gas region, the first diaphragm configured to actuate to pressurize process gas in the process gas region, a second compressor head comprising:

an inlet, an outlet, a second head cavity, and a second diaphragm dividing the second head cavity into a second work oil region and a process gas region, the second diaphragm configured to actuate to pressurize process gas in the process gas region, a hydraulic drive configured to intensify work oil and alternatingly provide intensified work oil to the first and second compressor heads, the hydraulic drive comprising:

a first diaphragm piston configured to intensify work oil against the first diaphragm, a second diaphragm piston configured to intensify work oil against the second diaphragm, and a hydraulic actuator configured to power the first and second diaphragm pistons, wherein the first diaphragm piston and the second diaphragm piston are configured to alternatingly intensify the work oil in the respective first or second work oil region to an intensified pressure and thereby actuate the respective first or second diaphragm;

a hydraulic circuit connecting the outlet of the first compressor head to the inlet of the first compressor head and connecting the outlet of the second compressor head to the inlet of the second compressor head, the hydraulic circuit comprising:

an oil reservoir configured to collect overpumped work oil via the outlets of the first and second compressor heads, a hydraulic accumulator configured to provide a supplemental supply of work oil to the inlets of the first and second compressor heads, an injector pump in communication with the hydraulic accumulator, the injector pump configured to produce a variable volumetric displacement of supplemental work oil from the oil reservoir to the hydraulic accumulator, the injector pump comprising:

a pump operatively coupled to the hydraulic accumulator, a pressure relief mechanism comprising:

a first pressure relief valve in communication with the outlet of the first compressor head and configured to relieve the pressurized work oil from the work oil region, the first pressure relief valve comprising a hydraulic relief setting corresponding to a first target pressure condition of the pressurized work oil relative to the process gas discharge pressure, and a second pressure relief valve in communication with the outlet of the second compressor head and configured to relieve the pressurized work oil from the work oil region, the pressure relief valve comprising a hydraulic relief setting corresponding to a second target pressure condition of the pressurized work oil relative to the process gas discharge pressure; and a feedback mechanism configured to control the injector pump, the feedback mechanism comprising:

one or more measurement devices configured to sense or measure a current condition of the intensified work oil flowing out one or more of the first compressor head and the second compressor head, the one or more measurement devices of the feedback mechanism comprising one or more of a flow meter downstream of the outlet of one or more of the first compressor head and the second compressor head, a position sensor in the pressure relief valve, and a pressure transducer located downstream of the pressure relief valve, and wherein the feedback mechanism is configured to adjust the volumetric displacement of the injector pump in response to the current condition.

14. An active oil injection system in a diaphragm compressor, comprising:

a diaphragm compressor comprising:

a compressor head comprising:

a work oil head support plate and a process gas head support plate defining a diaphragm cavity therebetween, the work oil head support plate comprising a piston cavity, an inlet, and an outlet, and a metallic diaphragm mounted between the work oil head support plate and the process gas head support plate, the metallic diaphragm dividing the diaphragm cavity into a work oil region and a process gas region, the work oil region being in separate communication with each of the piston cavity, the inlet, and the outlet, wherein the metallic diaphragm is configured to actuate from a first position proximate the work oil head support plate to a second position proximate the process gas head support plate to pressurize process gas in the process gas region to a process gas discharge pressure, a drive configured to intensify and supply primary work oil to the compressor head, the drive comprising:

a drive cavity extending from the compressor head and in communication with the work oil region via the piston cavity, a piston mounted in the drive cavity and defining the volume of the work oil region, and an actuator configured to power the piston, wherein, during a discharge cycle, the drive is configured to power the piston to move toward the compressor head to intensify primary work oil in the work oil region from a first pressure to an intensified pressure and thereby actuate the metallic diaphragm to the second position;

a hydraulic circuit connecting the outlet of the work oil head support plate to the inlet of the work oil head support plate, the hydraulic circuit comprising:

an oil reservoir configured to collect overpumped work oil from the work oil region via the outlet of the work oil head support plate, an injector pump in communication with the oil reservoir, the injector pump configured to produce supplemental work oil from the oil reservoir to the inlet of the work oil head support plate; and a pressure relief mechanism operatively coupled to the work oil region of the diaphragm cavity, the pressure relief mechanism comprising:

a pressure relief valve in communication with the outlet of the work oil head support plate and configured to relieve the pressurized work oil from the work oil region, the pressure relief valve comprising a hydraulic relief setting corresponding to a target pressure condition of the pressurized work oil relative to the process gas discharge pressure, and a control valve configured to actively adjust the hydraulic relief setting of the pressure relief valve based on a current condition of the process gas; and a feedback mechanism configured to control the injector pump, the feedback mechanism comprising:

a first measurement device operatively coupled to one or more of the outlet and the pressure relief valve, the first measurement device configured to detect a current condition of the pressurized work oil flowing through the pressure relief valve from the work oil region, the first measurement device of the feedback mechanism comprising one or more of a flow meter downstream of the outlet, a position sensor in the pressure relief valve, and a pressure transducer located downstream of the pressure relief valve.

15. The active oil injection system of claim 14, wherein the hydraulic relief setting is a pressure of is at least 10-20% above a measured process gas discharge pressure.

16. The active oil injection system of claim 14, the hydraulic circuit further comprising a hydraulic accumulator configured to provide a supply of supplemental work oil to the inlet of the work oil head support plate, wherein the injector pump is in communication with the hydraulic accumulator, the injector pump configured to produce a variable volumetric displacement of the supplemental work oil from the oil reservoir to the hydraulic accumulator;

wherein the oil reservoir is in fluid communication with the drive of the diaphragm compressor;

wherein the actuator of the diaphragm compressor is a crank-slider mechanism, and the oil reservoir is a crankcase of the crank-slider mechanism;

wherein the hydraulic circuit further comprises:

an inlet check valve operatively coupled to the inlet of the work oil head support plate, the inlet check valve configured to prevent backflow from the work oil region to the hydraulic accumulator, and an outlet check valve operatively coupled to the outlet of the work oil head support plate, the outlet check valve configured to prevent backflow from the hydraulic circuit to the work oil region;

wherein, during a suction cycle of the diaphragm compressor at the compressor head, the drive of the diaphragm compressor is configured to move the piston away from the compressor head to depressurize the work oil region and thereby pull the metallic diaphragm to the first position, and wherein, during the suction cycle, the hydraulic accumulator is configured to supply an injection volume of the supplemental work oil to the inlet of the work oil head support plate.

17. The active oil injection system of claim 16, wherein the feedback mechanism is configured to adjust the volumetric displacement of the injector pump to the hydraulic accumulator in response to the detected current condition; and wherein the injection volume from the hydraulic accumulator corresponds to the volume of overpump flow of pressurized work oil through the pressure relief valve; wherein the injector pump is configured to charge the hydraulic accumulator during both the discharge and suction cycles of the diaphragm compressor.

18. The active oil injection system of claim 14, the injector pump further comprising a motor configured to drive the pump, the pump and motor of the injector pump comprising a pump and motor selected from one of: a variable speed motor with a fixed displacement hydraulic pump, a fixed speed motor with a variable displacement hydraulic pump, and a variable speed motor with a variable displacement hydraulic pump.

19. The active oil injection system of claim 14, the hydraulic circuit further comprising a metering actuator operatively coupled to the inlet, the metering actuator configured to inject the supplemental work oil selectively during each of a suction cycle and the discharge cycle of the diaphragm compressor.

20. The active oil injection system of claim 14, the pressure relief valve comprising a valve spring and an adjustable pneumatic pressure bias, the control valve configured to actively adjust the hydraulic relief setting by adjusting the pneumatic pressure bias.

21. The active oil injection system of claim 14, wherein the pressure transducer located downstream of the pressure relief valve comprises a pressure transducer with a temperature transducer each located downstream of the pressure relief valve.

22. The active oil injection system of claim 14, further comprising a hydraulic power unit driving the actuator of the diaphragm compressor; wherein the hydraulic power unit comprises a second hydraulic circuit of oil that is separate from the work oil of the hydraulic circuit of the active oil injection system.

23. The active oil injection system of claim 22, wherein the oil reservoir is a hydraulic tank operatively coupled with the hydraulic power unit, the injector pump comprising an active control valve configured to selectively isolate the injector pump from the hydraulic power unit of the diaphragm compressor.

24. The active oil injection system of claim 14, the drive of the diaphragm compressor comprising a hydraulic drive supplied by a plurality of pressure rails configured to supply work oil to power the piston, the plurality of pressure rails comprising:

a low-pressure rail supplying low-pressure work oil via a passive first valve, a medium-pressure rail supplying medium-pressure work oil via an active second valve, and a high-pressure rail supplying high-pressure work oil via an active third valve;

wherein the drive of the diaphragm compressor further comprising a hydraulic power unit providing the supply of work oil to the medium-pressure rail and the high-pressure rail, the hydraulic power unit comprising a hydraulic pump and motor.

* * * * *